US009074361B2

(12) United States Patent
Mochita et al.

(10) Patent No.: US 9,074,361 B2
(45) **Date of Patent: *Jul. 7, 2015**

(54) SANITARY WASHING APPARATUS

(75) Inventors: Masayuki Mochita, Fukuoka-ken (JP); Minoru Sato, Fukuoka-ken (JP); Masako Numao, Fukuoka-ken (JP)

(73) Assignee: TOTO LTD., Fukuoka (JP)

( * ) Notice: Subject to any disclaimer, the term of this patent is extended or adjusted under 35 U.S.C. 154(b) by 1002 days.

This patent is subject to a terminal disclaimer.

(21) Appl. No.: 13/182,511

(22) Filed: Jul. 14, 2011

(65) Prior Publication Data

US 2012/0011647 A1 Jan. 19, 2012

(30) Foreign Application Priority Data

Jul. 16, 2010 (JP) ..... 2010-162327
Jul. 16, 2010 (JP) ..... 2010-162328
Jan. 28, 2011 (JP) ..... 2011-016351

(51) Int. Cl.
*E03D 9/08* (2006.01)
*A47K 3/20* (2006.01)

(52) U.S. Cl.
CPC ..... *E03D 9/08* (2013.01)

(58) Field of Classification Search
CPC ..... E03D 9/08
USPC ..... 4/420.4, 420.5, 443, 444, 447, 448
See application file for complete search history.

(56) References Cited

U.S. PATENT DOCUMENTS 5,884,345 A 3/1999 Sugiyama
6,754,912 B1 6/2004 Hayashi et al.
8,381,323 B2 * 2/2013 Mochita et al. ..... 4/420.3
2003/0140407 A1 7/2003 Matsumoto
2004/0019962 A1 2/2004 Sato et al.

FOREIGN PATENT DOCUMENTS

JP 2000-282545 A 10/2000
JP 2001-090155 A 4/2001
JP 2001-279779 A 10/2001
JP 2002-220867 A 8/2002
JP 2003-247260 A 9/2003
JP 2004-092320 A 3/2004
JP 2007-100370 A 4/2007
JP 2008-050782 A 3/2008

OTHER PUBLICATIONS

Japanese Office action for 2010-162328 dated Nov. 17, 2010.
Japanese Office action for 2010-162328 dated Feb. 4, 2011.

* cited by examiner

*Primary Examiner* — Tuan N Nguyen
(74) *Attorney, Agent, or Firm* — Pearne & Gordon LLP

(57) ABSTRACT

According to one embodiment, a sanitary washing apparatus includes a nozzle including a jetting port and configured to squirt water from the jetting port and to cause the water to impinge on female private parts. The nozzle is operable to switch between a first jetting and a second jetting. The first jetting squirts the water from the jetting port to cause the water to impinge on a first range of the female private parts, and the second jetting squirts the water from the jetting port more diffusively than the first jetting to cause the water to impinge evenly on a second range wider than the first range without moving the jetting port. The water is squirted so that flow velocity in the first range of the first jetting is slower than flow velocity in the second range of the second jetting.

13 Claims, 12 Drawing Sheets

SANITARY WASHING APPARATUS

CROSS-REFERENCE TO RELATED APPLICATIONS

This application is based upon and claims the benefit of priorities from the prior Japanese Patent Application No. 2010-162327, filed on Jul. 16, 2010, the prior Japanese Patent Application No. 2010-162328, filed on Jul. 16, 2010, and the prior Japanese Patent Application No. 2011-016351, filed on Jan. 28, 2011; the entire contents of which are incorporated herein by reference.

FILED

An aspect of the invention relates generally to a sanitary washing apparatus, specifically relates to a sanitary washing apparatus for washing a female private parts of a user seated on a sit-down toilet stool with water.

BACKGROUND

JP-A-2000-282545 discloses a human body washing apparatus having a bidet washing function. In this bidet washing function, wide washing with a large washing area and spot washing with a small washing area can be changed by button control. The human body washing apparatus described in JP-A-2000-282545 can provide, for instance, a jetting mode for washing with a low flow rate and a large washing area without decreasing the washing power. However, the human body washing apparatus described in JP-A-2000-282545 may jet water in a wide range by moving the nozzle. In this case, the user may feel discomfort in bidet washing. Hence, there is room for improvement in this respect.

In another human body washing apparatus described in JP-A-2001-90155, a swirling force about the axial center of the jetting port is imparted to the supplied water. The water is guided to the jetting port and jetted with a swirling force from the jetting port. In the human body washing apparatus described in JP-A-2001-90155, the water can be spirally jetted without nozzle movement, and the washing range can be expanded in a two-dimensional shape determined by the swirling. However, in the spiral jetting, a hollow portion inside the spirally jetted water occurs at the time of impingement of water. Hence, there is room for improvement with regard to the washing performance in the hollow portion. More specifically, for instance, during women's menstruation, menstrual blood dirt may be attached over a wide range around the female private parts. Hence, further improvement is required to respond to the demand for washing a wide range quickly at once.

Furthermore, JP-A-2001-279779 discloses a human private parts washing apparatus capable of changing the jetting condition of water jetted from the nozzle to appropriately change e.g. the water force and the width and shape of the washing range in accordance with the property of bodily wastes ejected from the user. The human private parts washing apparatus described in JP-A-2001-279779 can achieve reliable and high washing performance without complicated manipulation and adjustment irrespective of the type and state of bodily wastes. However, the human private parts washing apparatus described in JP-A-2001-279779 provides a "sticky mode" and a "dry mode" for washing vaginal discharge. In the "sticky mode", a strong water force is realized by making the flow velocity higher and the air mixing ratio lower than in the "dry mode". The "sticky mode" is intended for vaginal discharge less likely to spread around the vaginal opening, whereas the "dry mode" is intended for vaginal discharge more likely to spread. Hence, the washing range is made wider in the latter than in the former. Thus, the water force is strong in the central portion of the washing range, and may unnecessarily apply strong stimuli to the woman's delicate area. Hence, a problem still remains as a feeling of washing required for bidet washing in which a wide range is desirably washed quickly at once. Furthermore, in the case of simply widening and narrowing the washing range, when the washing range is switched, stimuli in washing the narrow range are made much stronger than those in washing the wide range and cause discomfort.

SUMMARY

According to an aspect of the invention, there is provided a sanitary washing apparatus includes a nozzle including a jetting port and configured to squirt water from the jetting port and to cause the water to impinge on female private parts. The nozzle is operable to switch between a first jetting and a second jetting. The first jetting squirts the water from the jetting port to cause the water to impinge on a first range of the female private parts, and the second jetting squirts the water from the jetting port more diffusively than the first jetting to cause the water to impinge evenly on a second range wider than the first range without moving the jetting port. The water is squirted so that flow velocity in the first range of the first jetting is slower than flow velocity in the second range of the second jetting.

DETAILED DESCRIPTION

Figure 1:
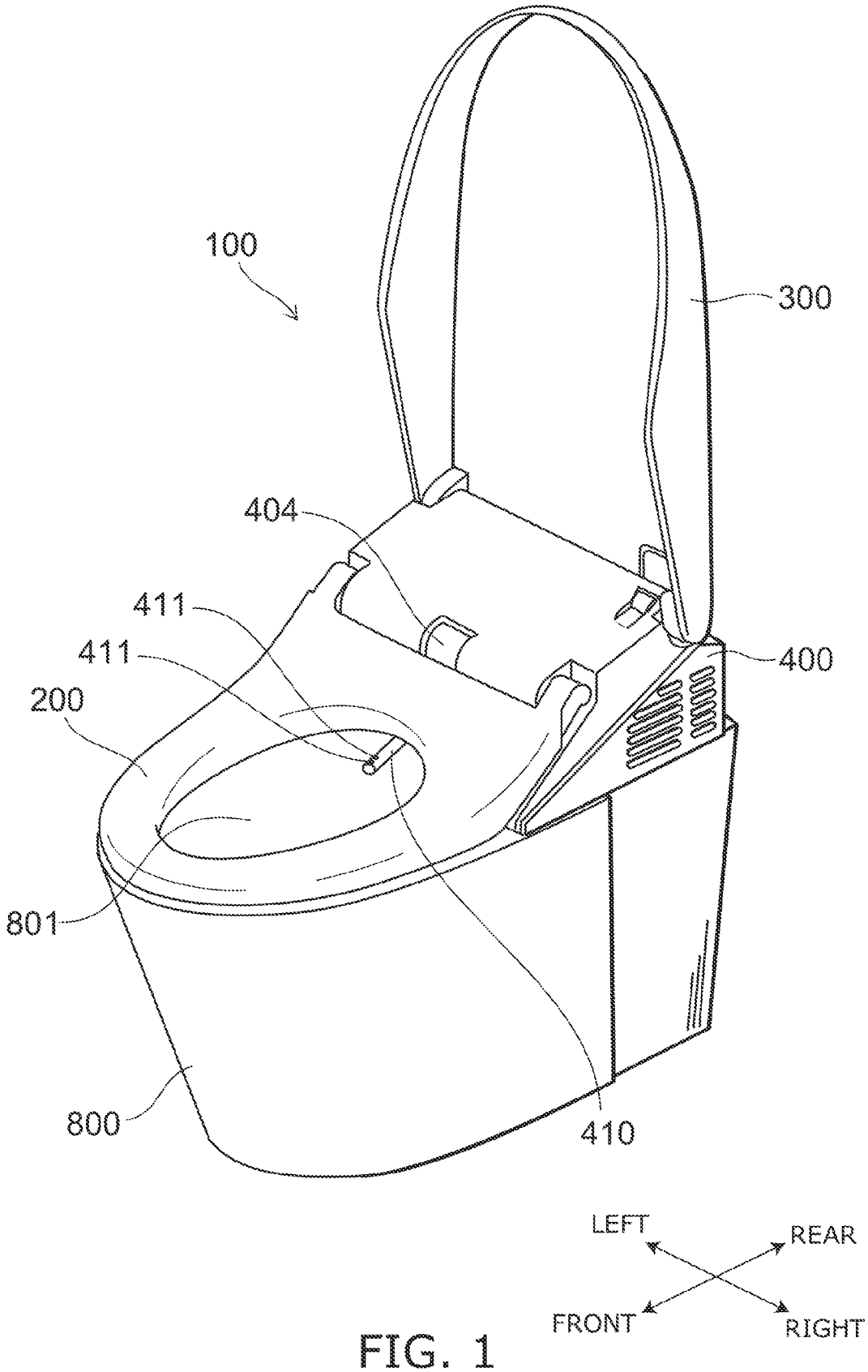
FIG. 1 is a perspective schematic view showing a toilet apparatus equipped with a sanitary washing apparatus according to an embodiment of the invention.

The first invention is a sanitary washing apparatus including a nozzle including a jetting port and configured to squirt water from the jetting port and to cause the water to impinge on female private parts. The nozzle is operable to switch between a first jetting and a second jetting. The first jetting squirts the water from the jetting port to cause the water to impinge on a first range of the female private parts, and the second jetting squirts the water from the jetting port more diffusively than the first jetting to cause the water to impinge evenly on a second range wider than the first range without moving the jetting port. The water is squirted so that flow velocity in the first range of the first jetting is slower than flow velocity in the second range of the second jetting.

In this sanitary washing apparatus, the first jetting and the second jetting can be switchably performed. The first jetting squirts water from the jetting port of the nozzle so that the water impinges on the first range of the female private parts. The second jetting squirts water from the jetting port of the nozzle so that the water impinges evenly on the second range wider than the first range. That is, the user can switch as desired between the first jetting for washing a narrower range quickly at once and the second jetting for intensively washing a wider range. The flow velocity in the central portion of the first range of the first jetting is slower than the flow velocity in the second range of the second jetting.

The second jetting can cause the water to impinge on a wider range of the female private parts of a user seated on the toilet seat. Thus, the desired wide range can be washed quickly at once.

On the other hand, the first jetting can wash a narrower range than the second jetting. Furthermore, the first jetting can suppress unnecessary application of strong stimuli to the woman's delicate area located around the center of the female private parts. Thus, bidet washing with a very comfortable feeling of washing can be realized.

Accordingly, the water is squirted from the nozzle with the width of the impingement range of the water switched in accordance with the purpose of bidet washing. The water impinges with an impingement force adapted to the width of the impingement range on the female private parts. Thus, bidet washing can be performed with an impingement force adapted to the width of the impingement range of water in bidet washing.

The second invention is a sanitary washing apparatus including a nozzle including a jetting port and configured to squirt water from the jetting port and to cause the water to impinge on female private parts. The nozzle is operable to switch between a first jetting and a second jetting. The first jetting squirts the water from the jetting port to cause the water to impinge on a first range of the female private parts, and the second jetting squirting the water from the jetting port more diffusively than the first jetting to cause the water to impinge evenly on a second range wider than the first range without moving the jetting port. The nozzle includes an impingement force suppression device configured to suppress impingement force in the first range of the first jetting when the second jetting is switched to the first jetting.

In this sanitary washing apparatus, the first jetting and the second jetting can be switchably performed. The first jetting squirts water from the jetting port of the nozzle so that the water impinges on the first range of the female private parts. The second jetting squirts water from the jetting port of the nozzle so that the water impinges evenly on the second range wider than the first range. That is, the user can switch as desired between the first jetting for washing a narrower range quickly at once and the second jetting for intensively washing a wider range. Furthermore, the impingement force suppression device causes the water to be squirted so as to suppress the impingement force of the first jetting on the female private parts when the second jetting for washing a wide range is switched to the first jetting for washing a narrow range.

The second jetting can cause the water to impinge on a wider range of the female private parts of a user seated on the toilet seat. Thus, the desired wide range can be washed quickly at once. On the other hand, the first jetting can wash a narrower range than the second jetting. Furthermore, the first jetting can suppress unnecessary application of strong stimuli to the woman's delicate area located around the center of the female private parts. Thus, bidet washing with a very comfortable feeling of washing can be realized.

Furthermore, when the second jetting for washing a wide range is switched in midstream to the first jetting for washing a narrow range, the impingement force suppression device causes the water to be squirted so as to suppress the impingement force of the first jetting on the female private parts. Hence, in the first jetting, even if the water impinges in a concentrated manner on a narrower range than in the second jetting, there is no case where unnecessarily strong stimuli are felt.

Accordingly, the water is squirted from the nozzle with the width of the impingement range of the water switched in accordance with the purpose of bidet washing. The water is squirted with an impingement force adapted to the width of the impingement range on the female private parts. Furthermore, in particular, switching from the wide impingement range to the narrow one does not cause unnecessarily strong stimuli. Thus, comfortable bidet washing can be performed with an impingement force adapted to the width of the impingement range of water in bidet washing.

The third invention is the sanitary washing apparatus according the second invention, wherein when the second jetting is switched to the first jetting, the impingement force suppression device makes flow velocity in the first range of the first jetting slower than flow velocity in the second range of the second jetting to suppress the impingement force in the first range of the first jetting.

In this sanitary washing apparatus, the first jetting and the second jetting can be switchably performed. The first jetting squirts water from the jetting port of the nozzle so that the water impinges on the first range of the female private parts. The second jetting squirts water from the jetting port of the nozzle so that the water impinges evenly on the second range wider than the first range. That is, the user can switch as desired between the first jetting for washing a narrower range quickly at once and the second jetting for intensively washing a wider range. The flow velocity in the central portion of the first range of the first jetting is slower than the flow velocity in the second range of the second jetting.

The second jetting can cause the water to impinge on a wider range of the female private parts of a user seated on the toilet seat. Thus, the desired wide range can be washed quickly at once. Furthermore, the flow velocity in the second range of the second jetting is faster than the flow velocity in the central portion of the first range of the first jetting. Hence, the peripheral portion of the female private parts can be washed with high washing power. Thus, menstrual blood dirt attached to a wide range around the female private parts can be efficiently washed away.

On the other hand, the first jetting can wash a narrower range than the second jetting. Furthermore, the first jetting can suppress unnecessary application of strong stimuli to the woman's delicate area located around the center of the female private parts. Thus, bidet washing with a very comfortable feeling of washing can be realized.

Accordingly, the water is squirted from the nozzle with the width of the impingement range of the water switched in accordance with the purpose of bidet washing. The water impinges with an impingement force adapted to the width of the impingement range on the female private parts. Thus, bidet washing can be performed with an impingement force adapted to the width of the impingement range of water in bidet washing.

Furthermore, when the second jetting for washing a wide range is switched to the first jetting for washing a narrow range, the impingement force suppression device causes the water to be squirted so as to suppress the impingement force of the first jetting on the female private parts. Hence, in the first jetting, even if the water impinges in a concentrated manner on a narrower range than in the second jetting, there is no case where unnecessarily strong stimuli are felt.

The fourth invention is the sanitary washing apparatus according to the second invention, wherein the impingement force suppression device squirts the water at a lower flow rate in the first jetting than in the second jetting.

In this sanitary washing apparatus, the first jetting squirts water so that the water impinges on the female private parts at a lower flow rate than in the second jetting. Thus, the first jetting can provide comfortable washing while suppressing unnecessary application of strong stimuli to the woman's delicate area located around the center of the female private parts. On the other hand, the second jetting impinges water on the female private parts at a higher flow rate than in the first jetting. Thus, the washing power of the second jetting is higher than the washing power of the first jetting. Hence, menstrual blood dirt attached to a wide range around the female private parts can be efficiently washed away.

The fifth invention is the sanitary washing apparatus according to the first invention, wherein area of the water occupying the jetting port as viewed in jetting direction of the water squirted from the jetting port is made larger in the first jetting than in the second jetting.

In this sanitary washing apparatus, when the water is squirted from the jetting port, the cross-sectional area is made relatively larger in the first jetting, whereas the cross-sectional area is made relatively smaller in the second jetting.

The sixth invention is the sanitary washing apparatus according to the first invention, wherein the nozzle includes a swirling chamber configured to swirl the water below the jetting port, and the water is squirted from the swirling chamber with swirling speed of the water in the swirling chamber in the first jetting made slower than in the second jetting.

In this sanitary washing apparatus, the swirling chamber is provided to swirl the water, and the water in the swirled state is supplied to the jetting port. Thus, the jetting form of the water squirted from the jetting port is controlled. Hence, the jetting form of the water can be varied by the simple method of varying the swirling speed.

The seventh invention is the sanitary washing apparatus according to the sixth invention, wherein the nozzle includes a deceleration device configured to make the flow velocity of the water squirted from the jetting port in the first jetting slower than the flow velocity of the water squirted from the jetting port in the second jetting.

In this sanitary washing apparatus, the flow velocity of the water squirted from the jetting port can be made slower in the first jetting than in the second jetting. Thus, without providing a large-scale device or instrument, the flow velocity can be varied between in the first jetting and in the second jetting.

The eighth invention is the sanitary washing apparatus according to the seventh invention, wherein the deceleration device includes an air mixing section configured to mix air into the water jetted from the swirling chamber, and the air mixing section makes mixing amount of air larger in the first jetting than in the second jetting.

In this sanitary washing apparatus, the mixing amount of air in the air mixing section is made larger in the first jetting than in the second jetting. Thus, the pressure loss occurring in mixing air into the water is higher in the first jetting than in the second jetting. Hence, the flow velocity of the water can be made lower in the first jetting than in the second jetting.

The ninth invention is the sanitary washing apparatus according to the eighth invention, wherein in the first jetting, the water with outer peripheral side of the jetted water being in a granulated state is supplied through the air mixing section to the jetting port, and in the second jetting, the water with outer peripheral side of the jetted water being in a water film state is supplied through the air mixing section to the jetting port.

In this sanitary washing apparatus, in the first jetting, the water passing through the air mixing section is granular. Thus, the water is more likely to involve air. On the other hand, in the second jetting, the outer periphery of the jetted water is in the state of water film. Thus, the water is less likely to involve air. Hence, the mixing amount of air involved in the water is relatively larger in the first jetting than in the second jetting. Thus, the flow velocity of the water can be made lower in the first jetting than in the second jetting.

The tenth invention is the sanitary washing apparatus according to the second invention, wherein the first jetting and the second jetting cause the water to be granulated and squirted from the jetting port, and the impingement force suppression device granulates the water so that particle diameter is smaller in the first jetting than in the second jetting.

In this sanitary washing apparatus, the particle diameter of the granulated water is smaller in the first jetting than in the second jetting. Hence, the feeling of stimulation at the time of impingement of the first jetting can be weakened.

The eleventh invention is the sanitary washing apparatus according to the first invention, further including a water-pressure modulator configured to provide pulsation to flow of the water. In the first jetting, the water-pressure modulator is activated to provide pulsation to the flow of the water squirted from the jetting port to continuously change the flow velocity of the water, and in the second jetting, the water is squirted from the jetting port without activating the water-pressure modulator.

In this sanitary washing apparatus, in the first jetting, the flow velocity of the water is continuously changed. This causes an overtaking phenomenon of the water due to the difference of the flow velocity after the water is squirted. Thus, the cross-sectional area of the squirted water can be intermittently increased. Hence, in the first jetting, even if the flow rate of the water decreases, the decrease of the feeling of volume can be suppressed.

The twelfth invention is the sanitary washing apparatus according to the first invention, wherein the nozzle further includes: a throttle configured to squirt the water at the jetting port; a first water supply channel configured to supply the water to the throttle while swirling the water; a second water supply channel configured to supply the water to the throttle while swirling the water to a degree lower than degree of swirling of the water supplied from the first water supply channel, or without swirling the water; and a channel selection device configured to supply the water to the second water supply channel when performing the first jetting, and to supply the water to the first water supply channel when performing the second jetting.

The user can appropriately change the setting of the ratio of the flow rate of the water passing through the first water supply channel to the flow rate of the water passing through the second water supply channel. Thus, the user can switch as desired between the second jetting for washing a wider range quickly at once and the first jetting for intensively washing a narrower range. Hence, bidet washing can be performed with an impingement force adapted to the width of the impingement range of water in bidet washing.

The thirteenth invention is the sanitary washing apparatus according to the first invention, wherein the jetting port includes at least a first jetting port and a second jetting port, and the first jetting jets water from the first jetting port, and the second jetting jets water from the second jetting port.

In this sanitary washing apparatus, the first jetting and the second jetting can be switchably performed. The first jetting squirts water from the first jetting port of the nozzle so that the water impinges on the first range of the female private parts. The second jetting squirts water from the second jetting port of the nozzle so that the water impinges evenly on the second range wider than the first range. That is, the user can switch as desired between the first jetting for washing a narrower range quickly at once and the second jetting for intensively washing a wider range. The flow velocity in the central portion of the first range of the first jetting is slower than the flow velocity in the second range of the second jetting.

The second jetting can cause the water to impinge on a wider range of the female private parts of a user seated on the toilet seat. Thus, the desired wide range can be washed quickly at once.

On the other hand, the first jetting can wash a narrower range than the second jetting. Furthermore, the first jetting can suppress unnecessary application of strong stimuli to the woman's delicate area located around the center of the female private parts. Thus, bidet washing with a very comfortable feeling of washing can be realized.

Accordingly, the water is squirted from the nozzle with the width of the impingement range of the water switched in accordance with the purpose of bidet washing. The water impinges with an impingement force adapted to the width of the impingement range on the female private parts. Thus, bidet washing can be performed with an impingement force adapted to the width of the impingement range of water in bidet washing. Furthermore, the first jetting and the second jetting are switchably performed with separate jetting ports. Hence, switching can be performed more rapidly than in such a configuration as switching between the first jetting and the second jetting with a single jetting port. Furthermore, the aforementioned effect can be achieved with a simple structure.

Embodiments of the invention will now be described with reference to the drawings. In the drawings, similar components are labeled with like reference numerals, and the detailed description thereof is omitted as appropriate.

FIG. 1 is a perspective schematic view showing a toilet apparatus equipped with a sanitary washing apparatus according to an embodiment of the invention.

The toilet apparatus shown in FIG. 1 includes a sit-down toilet stool (hereinafter simply referred to as "toilet stool" for convenience of description) 800 and a sanitary washing apparatus 100 provided thereon. The sanitary washing apparatus 100 includes a casing 400, a toilet seat 200, and a toilet lid 300. The toilet seat 200 and the toilet lid 300 are each pivotally supported on the casing 400 in an openable/closable manner.

The casing 400 includes therein e.g. a private parts washing functional part for washing the female private parts of a user seated on the toilet seat 200. Furthermore, for instance, the casing 400 includes a seating sensor 404 for sensing seating of a user on the toilet seat 200. When the seating sensor 404 is sensing a user seated on the toilet seat 200, the user can manipulate a manipulator such as a remote control, not shown, to advance a nozzle 410 into the bowl 801 of the toilet stool 800. In the sanitary washing apparatus 100 shown in FIG. 1, the nozzle 410 is shown in the state of being advanced into the bowl 801.

One or more jetting ports 411 are provided in the tip portion of the nozzle 410. The nozzle 410 can squirt water from the jetting port 411 provided in the tip portion to wash the female private parts of the user seated on the toilet seat 200. For instance, among the two jetting ports 411 in the nozzle 410 shown in FIG. 1, one jetting port 411 is intended for bidet washing, and the other jetting port 411 is intended for bottom washing. Here, the term "water" used herein refers not only to cold water, but also to heated hot water.

Figure 2:
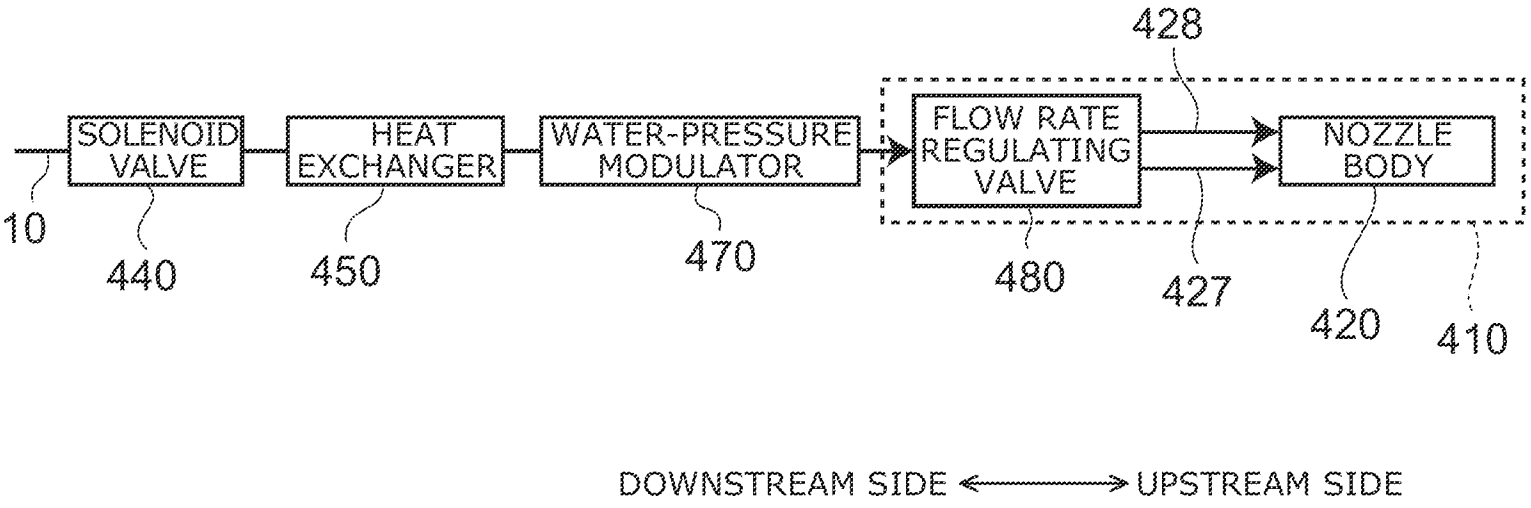
FIG. 2 is a block diagram showing the main configuration of the sanitary washing apparatus according to the embodiment.

FIG. 2 is a block diagram showing the main configuration of the sanitary washing apparatus according to the embodiment.

The sanitary washing apparatus 100 according to the embodiment includes a flow channel 10 for guiding water supplied from a water supply source, not shown, such as a water tap and a water storage tank. A solenoid valve 440 is provided on the upstream side of the flow channel 10. The solenoid valve 440 is an openable/closable solenoid valve, and regulates water supply to a heat exchanger 450 based on commands from a controller, not shown, provided inside the casing 400.

A heat exchanger 450 is provided on the downstream side of the solenoid valve 440. The heat exchanger 450 heats supplied water to hot water at a prescribed temperature. Here, the heat exchanger 450 may be a heat exchanger of the instantaneous heating type using e.g. a sheath heater, or a heat exchanger of the hot water storage heating type using a hot water storage tank.

A water-pressure modulator 470 is provided on the downstream side of the heat exchanger 450. This water-pressure modulator 470 provides pulsation to the flow of water in the flow channel 10. Thus, the water-pressure modulator 470 can provide pulsation to the water squirted from the jetting port 411 of the nozzle 410.

The nozzle 410 is provided on the downstream side of the water-pressure modulator 470. The nozzle 410 includes a flow rate regulating valve (channel selection device) 480 for adjusting the water force (flow rate), a wide jetting flow channel (first water supply channel) 427 for passing water in wide jetting, a spot jetting flow channel (second water supply channel) 428 for passing water in spot jetting, and a nozzle body 420. The flow rate regulating valve 480 can adjust the water force, and can open/close and switch water supply to the nozzle 410. More specifically, the sanitary washing apparatus 100 according to the embodiment can perform spot jetting (first jetting) for squirting water from the jetting port 411 of the nozzle 410 so that the water impinges on a first range of the female private parts, and wide jetting (second jetting) for squirting water from the jetting port 411 of the nozzle 410 so that the water impinges evenly on a second range wider than the first range.

Based on commands from a controller, not shown, under switch manipulation of a remote control, the flow rate regulating valve 480 can pass water to the wide jetting flow channel 427 or the spot jetting flow channel 428. Alternatively, the flow rate regulating valve 480 can pass water to the wide jetting flow channel 427 and the spot jetting flow channel 428 with a prescribed ratio. Thus, the user can switch between the wide jetting flow channel 427 and the spot jetting flow channel 428, or can appropriately change the setting of the ratio of the flow rate of the water passing through the wide jetting flow channel 427 to the flow rate of the water passing through the spot jetting flow channel 428. Hence, the user can switch as desired between the wide jetting for washing a wider range quickly at once and the spot jetting for intensively washing a narrower range. This will be described later in detail.

The nozzle 410 can be advanced into or retracted from the bowl 801 of the toilet stool 800 under a driving force from e.g. a motor. Then, in the state of being advanced into the bowl 801, the nozzle 410 can squirt water from the jetting port 411 to wash the female private parts of the user seated on the toilet seat 200.

Next, the structure of the nozzle 410 and the jetting forms of the wide jetting and the spot jetting of the embodiment are described with reference to the drawings.

Figure 3:
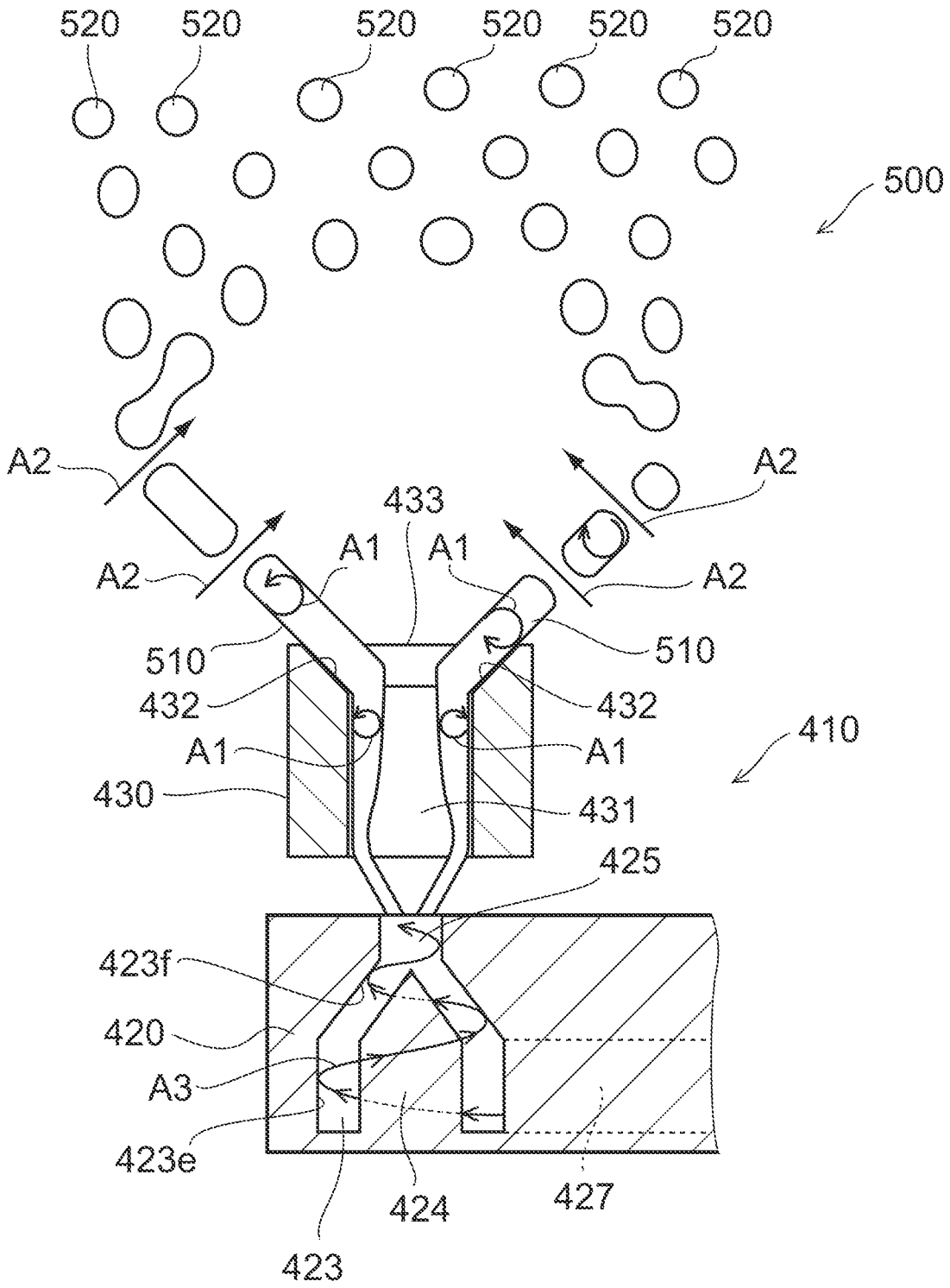
FIG. 3 is a sectional schematic view for describing wide jetting.

FIG. 3 is a sectional schematic view for describing the wide jetting.

The nozzle 410 of the embodiment includes a nozzle body 420 and a throat 430. The nozzle body 420 includes therein a wide jetting flow channel 427 for passing water supplied from a water source, not shown, a swirling chamber 423 capable of generating a swirling flow, and a communication channel (throttle) 425 for guiding water from the swirling chamber 423 to the throat 430. In the central portion of the swirling chamber 423, a protrusion 424 for generating a swirling flow with stabler swirling power is provided.

The swirling chamber 423 is a hollow chamber formed from a large diameter inner peripheral wall 423*e* having a larger diameter at the bottom, and an inclined inner peripheral wall 423*f* having a diameter shrinking toward the communication channel 425. At one end of the inclined inner peripheral wall 423*f*, the inclined inner peripheral wall 423*f* is connected to the communication channel 425. On the other hand, the wide jetting flow channel 427 is connected eccentrically to the swirling chamber 423. More specifically, the wide jetting flow channel 427 is connected in the tangential direction of the large diameter inner peripheral wall 423*e* of the swirling chamber 423.

The throat 430 includes therein a throat flow channel 431 for passing water squirted from the communication channel 425 of the nozzle body 420. Furthermore, a jetting port 433 is formed at one end of the throat flow channel 431. The jetting port 433 is configured so that the water passed through the throat flow channel 431 is jetted outside the throat 430. That is, as in the nozzle 410 shown in FIG. 3, in the case where the nozzle 410 includes a throat 430, the jetting port 433 provided in the throat 430 functions as the jetting port 411 shown in FIG. 1. The throat flow channel 431 near the jetting port 433 includes a taper portion 432 having a flow channel expanding toward the jetting port 433.

Here, the nozzle 410 of the embodiment includes a gap between the nozzle body 420 and the throat 430. However, this gap does not necessarily need to be provided. That is, the nozzle body 420 and the throat 430 may be integrally formed, and the communication channel 425 and the throat flow channel 431 may be connected.

In the case of performing the wide jetting, the water supplied from a water source, not shown, is supplied through the wide jetting flow channel 427 to the nozzle 410 and flows into the swirling chamber 423. Here, the wide jetting flow channel 427 is connected in the tangential direction of the large diameter inner peripheral wall 423*e* of the swirling chamber 423. Hence, as indicated by arrow A3 shown in FIG. 3, the water poured into the swirling chamber 423 swirls along the large diameter inner peripheral wall 423*e* and the inclined inner peripheral wall 423*f* at a speed faster than in the spot jetting described later. Then, the water swirled in the swirling chamber 423 passes through the communication channel 425 while maintaining the swirling power, and is squirted into the throat flow channel 431 of the throat 430. At this time, the water squirted from the nozzle body 420 maintains the swirling power. Hence, the water is squirted in a hollow-conic shape as a liquid film including a hollow portion in the central portion. In the following, for convenience of description, the water squirted in such a hollow-conic shape is referred to as "hollow-conic jetted water".

The water poured into the throat flow channel 431 flows along the inner wall of the throat flow channel 431 while maintaining the swirling power, and is guided to the jetting port 433. That is, the water passing through the throat flow channel 431 flows in contact with the inner wall of the throat flow channel 431. Hence, the water flowing in the throat flow channel 431 is subjected to resistance due to the frictional force from the inner wall of the throat flow channel 431. The flow velocity of the water is made lower toward the jetting port 433. Thus, as shown in FIG. 3, the thickness of the liquid film near the jetting port 433 is thicker than the thickness of the liquid film just squirted from the nozzle body 420, or the thickness of the liquid film just poured into the throat flow channel 431.

Furthermore, the flow velocity of the water flowing in the throat flow channel 431 is faster in the central portion of the throat flow channel 431 than near the inner wall of the throat flow channel 431, i.e., in the boundary layer. Hence, inside the water flowing in the throat flow channel 431, as indicated by arrow A1 shown in FIG. 3, vortices are generated in a direction traversing the liquid film. Furthermore, in the throat flow channel 431 near the jetting port 433, a taper portion 432 having a flow channel expanding toward the jetting port 433 is formed. Hence, the water squirted from the jetting port 433 flows along the taper portion 432. Thus, inside the water squirted from the jetting port 433, vortices are more likely to occur in a direction traversing the liquid film.

Then, the water squirted from the jetting port 433 is squirted as a liquid film including a hollow portion in the central portion, i.e., as a hollow-conic jetted water 510, and transitions to a water flow 520 granulated (hereinafter referred to as "granulated water flow" for convenience of description) at a position spaced to some extent from the jetting port 433. More specifically, inside the hollow-conic jetted water 510 squirted from the jetting port 433, vortices are generated in a direction traversing the liquid film. Hence, at a position spaced to some extent from the jetting port 433, cracks occur between adjacent vortices. Accordingly, as shown in FIG. 3, the hollow-conic jetted water 510 squirted from the jetting port 433 is fragmented at a position spaced to some extent from the jetting port 433. Thus, the hollow-conic jetted water 510 squirted from the jetting port 433 transitions to a granulated water flow 520. Then, the granulated water flow 520 is evenly distributed inside the region where the hollow-conic jetted water 510 is spread.

The pressure in the hollow portion of the hollow-conic jetted water 510 is lower than the pressure outside the hollow-conic jetted water 510. The reason for this is as follows. Air is less likely to enter the hollow portion of the hollow-conic jetted water 510 from outside. Furthermore, the air in the hollow portion is drawn out by the stream of the hollow-conic jetted water 510. Thus, the pressure in the hollow portion of the hollow-conic jetted water 510 is lower than the pressure outside the hollow-conic jetted water 510. This suppresses expansion of the jet diameter (cone diameter) of the hollow-conic jetted water 510.

Hence, the nozzle 410 of the embodiment can suppress impingement of the granulated water flow 520 outside the washing area. Thus, unnecessary wetting of the portion (e.g., thigh) outside the desired washing area can be suppressed. This can suppress discomfort felt by the user seated on the toilet seat 200 due to unnecessary wetting of the portion outside the desired washing area.

Furthermore, the granulated water flow 520 has a diameter of e.g. approximately 1 mm, larger than that of spray, which has a diameter of e.g. approximately 10-100 μm. This is because, as described above, the flow velocity of the water flowing in the throat flow channel 431 is made lower toward the jetting port 433, thus thickening the thickness of the liquid film near the jetting port 433. That is, the hollow-conic jetted water 510 squirted in the state of a thicker liquid film is forcibly granulated by vortices generated inside the throat 430. Hence, the granulated water flow 520 has a larger diameter than e.g. spray.

Accordingly, there is little danger that the granulated water flow 520 drifts in air and scatters to the outside of the desired washing area. That is, the nozzle 410 of the embodiment can suppress impingement of the granulated water flow 520 outside the washing area, and can suppress unnecessary wetting of the portion outside the desired washing area. Furthermore, because the granulated water flow 520 has a larger diameter, the impingement force in the impingement portion can be made higher. Hence, for instance, menstrual blood dirt during women's menstruation can be removed or released more rapidly, and washed away more rapidly.

As described above, the pressure in the hollow portion of the hollow-conic jetted water 510 is lower than the pressure outside the hollow-conic jetted water 510. This pressure in the hollow portion of the hollow-conic jetted water 510 is higher than the pressure in the hollow portion of the hollow-conic jetted water 510 in the case where the hollow-conic jetted water 510 is not fragmented. This is because, as indicated by arrow A2 shown in FIG. 3, air outside the hollow portion of the hollow-conic jetted water 510 enters the hollow portion through cracks generated between adjacent vortices, or through gaps between the fragmented parts of the hollow-conic jetted water 510. This can suppress the danger of failing to ensure a sufficiently wide washing range due to excessive decrease of pressure in the hollow portion of the hollow-conic jetted water 510. Furthermore, the pressure in the hollow portion of the hollow-conic jetted water 510 is higher than the pressure in the hollow portion of the hollow-conic jetted water 510 in the case where the hollow-conic jetted water 510 is not fragmented. This can suppress the occurrence of liquid film rippling.

Thus, the wide jetting of the embodiment can cause the water to impinge on a wider range of the female private parts of a user seated on the toilet seat 200 with the granulated water flow 520 evenly distributed in the hollow portion of the hollow-conic jetted water 510 (inside the region where the water 500 is spread). Thus, the desired wide range can be washed quickly at once.

Figure 4:
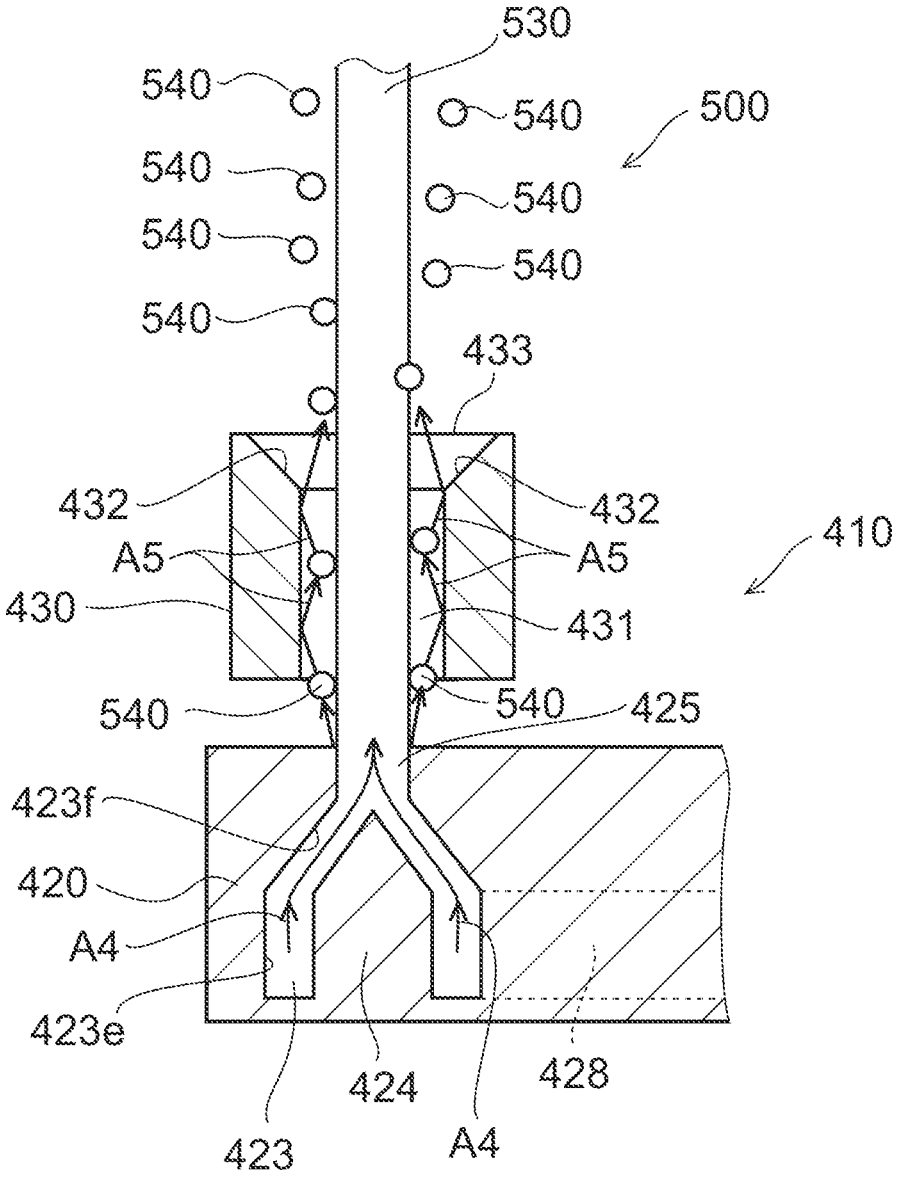
FIG. 4 is a sectional schematic view for describing spot jetting.

FIG. 4 is a sectional schematic view for describing the spot jetting.

Like the wide jetting flow channel 427, the nozzle body 420 includes therein a spot jetting flow channel 428 for passing water supplied from a water source, not shown. The spot jetting flow channel 428 is connected to the large diameter inner peripheral wall 423*e* of the swirling chamber 423 toward the axial center of the swirling chamber 423.

In the case of performing the spot jetting, the water supplied from a water source, not shown, is supplied through the spot jetting flow channel 428 to the nozzle 410 and flows into the swirling chamber 423. Here, the spot jetting flow channel 428 is connected to the large diameter inner peripheral wall 423*e* of the swirling chamber 423 toward the axial center of the swirling chamber 423. Hence, as indicated by arrow A4 shown in FIG. 4, the water poured into the swirling chamber 423 flows into the communication channel 425 without swirling or in the state of low swirling force. Then, the water poured into the communication channel 425 without swirling or in the state of low swirling force passes through the communication channel 425 and is squirted into the throat flow channel 431 of the throat 430. At this time, the water squirted from the nozzle body 420 has no swirling force, or has low swirling force. Hence, the water is squirted as a rectilinear flow 530.

Part of the rectilinear flow 530 squirted from the nozzle body 420 is separated from the rectilinear flow 530 to form water drops 540. The water drops 540 separated from the rectilinear flow 530 are reflected at the inner wall of the throat flow channel 431 as indicated by arrow A5 shown in FIG. 4. Then, part of the water drops 540 reflected at the inner wall of the throat flow channel 431 are merged again with the rectilinear flow 530. Thus, a gas-liquid interface is generated between the rectilinear flow 530 and the ambient air. Then, the water squirted from the nozzle body 420 is squirted from the jetting port 433 in the mixed state of the rectilinear flow 530 and the water drops 540. That is, the water squirted from the nozzle body 420 is squirted in a granular state.

The water squirted from the jetting port 433 in the spot jetting is not spread like the water squirted from the jetting port 433 in the wide jetting, and not squirted as a hollow-conic jetted water 510. That is, the water squirted from the jetting port 433 in the spot jetting is not in a hollow state, but in a continuous or filled state.

Thus, the spot jetting of the embodiment can wash a narrower range than the wide jetting. More specifically, the impingement range (first range) of the spot jetting is narrower than the impingement range (second range) of the wide jetting. In other words, the spread angle of the water of the wide jetting squirted from the communication channel 425 is larger than the spread angle of the water of the spot jetting squirted from the communication channel 425. Hence, the water of the wide jetting impinges on a wide range of the impingement surface at once without moving the nozzle. Thus, the impingement range (second range) of the wide jetting is wider than the impingement range (first range) of the spot jetting. The user can intensively wash the intended washing site as desired.

Hence, according to the embodiment, the user can appropriately change the setting of the ratio of the flow rate of the water passing through the wide jetting flow channel 427 to the flow rate of the water passing through the spot jetting flow channel 428. Thus, the user can switch as desired between the wide jetting for washing a wider range quickly at once and the spot jetting for intensively washing a narrower range.

Furthermore, in the spot jetting, the throat flow channel 431 is almost filled with water of the rectilinear flow 530 and the water drops 540. Hence, as described above, the water squirted from the jetting port 433 in the spot jetting is in a continuous or filled state. On the other hand, as described above with reference to FIG. 3, the water squirted from the jetting port 433 in the wide jetting forms a liquid film including a hollow portion in the central portion, i.e., a hollow-conic jetted water 510. Thus, the flow velocity of the water impinging on the female private parts in the spot jetting is slower than the flow velocity of the water impinging on the female private parts in the wide jetting.

Hence, the spot jetting of the embodiment can wash a narrower range than the wide jetting. Furthermore, the spot jetting can suppress unnecessary application of strong stimuli to the woman's delicate area located around the center of the female private parts. Thus, bidet washing with a very comfortable feeling of washing can be realized.

Furthermore, as in the nozzle 410 shown in FIGS. 3 and 4, in the case where a gap is provided between the nozzle body 420 and the throat 430, air can be taken into the throat flow channel 431 through the gap. Accordingly, the jetting form of the spot jetting for intensively washing a narrower range can be formed more easily. Furthermore, in the spot jetting, more air can be mixed into the water squirted from the jetting port 433. Thus, the spot jetting can provide a gentler feeling of washing than the wide jetting. Furthermore, by mixing air into the water, the apparent volume of the water is increased. Hence, in the spot jetting, even if the flow rate of the water decreases, the decrease of the feeling of volume can be suppressed.

In the embodiment, the mixing amount of air mixed into the water squirted from the jetting port 433 can be made larger in the spot jetting than in the wide jetting. This also enables the spot jetting to provide a gentler feeling of washing than the wide jetting. Hence, the spot jetting can further suppress unnecessary application of strong stimuli to the woman's delicate area located around the center of the female private parts. Thus, bidet washing with a more comfortable feeling of washing can be realized.

In the nozzle 410, a deceleration device for decelerating the water squirted from the squirting port of the swirling chamber 423 is provided between the swirling chamber 423 and the jetting port 411. The deceleration device decelerates the water so that the deceleration amount of the water in the spot jetting is larger than the deceleration amount of the water in the wide jetting.

The velocity of the swirling flow in the swirling chamber 423 is varied between in the wide jetting and in the spot jetting. Thus, the jetting form is varied by providing a velocity difference to the swirling flow. Furthermore, the deceleration device is provided between the squirting port of the swirling chamber 423 and the jetting port 411. The deceleration device decelerates the water so that the deceleration amount of the water in the spot jetting is larger than the deceleration amount of the water in the wide jetting. Thus, the flow velocity of the water jetted in the spot jetting is actively decelerated.

Specifically, in this configuration, the water is temporarily stored on the jetting port 411 side of the squirting port of the swirling chamber 423 so that the water squirted from the swirling chamber 423 is decelerated. The water is temporarily stored so that the storage amount of the water in the spot jetting is larger than the storage amount of the water in the wide jetting. Thus, the water squirted from the swirling chamber 423 plunges into the stored water. The amount of pressure loss in the spot jetting due to this plunge is made larger than the amount of pressure loss in the wide jetting. Thus, the deceleration amount of the water in the spot jetting is made larger than the deceleration amount of the water in the wide jetting.

Hence, the flow velocity in the spot jetting can be decreased by a simple deceleration method using the water squirted from the swirling chamber 423 and using the pressure loss of the stored water.

This deceleration device includes a throat flow channel 431 on the jetting port 411 side of the squirting port of the swirling chamber 423. The throat flow channel 431 has a larger inner diameter than the squirting port of the swirling chamber 423. In the spot jetting, a water flow with the outer periphery granulated is jetted from the squirting port of the swirling chamber 423. In the wide jetting, a water flow with the outer periphery shaped like a liquid film is jetted from the squirting port of the swirling chamber 423.

In the wide jetting, a water flow with the outer periphery shaped like a liquid film is jetted from the squirting port of the swirling chamber 423, and squirted from the jetting port 411 while maintaining the liquid film shape along the throat flow channel 431. On the other hand, in the spot jetting, a water flow with the outer periphery granulated is jetted from the squirting port of the swirling chamber 423, and the granulated water flow is decelerated by collision with the throat flow channel 431. Thus, the throat flow channel 431 having a larger diameter than the squirting port of the swirling chamber 423 is provided downstream of the swirling chamber 423 to vary the form of the water flow squirted from the squirting port. Simply by this configuration, the water can be reliably decelerated and jetted in the spot jetting relative to the wide jetting.

In the nozzle 410, on the jetting port 411 side of the squirting port of the swirling chamber 423, air is involved and naturally mixed into the water by the ejector effect. Thus, air is mixed into the water so that the mixing amount of air is larger in the spot jetting than in the wide jetting. Hence, the amount of pressure loss in the spot jetting due to this mixing of air is made larger than the amount of pressure loss in the wide jetting. Thus, the water is decelerated.

Thus, the mixing amount of air in the spot jetting is made larger than the mixing amount of air in the wide jetting. Hence, the amount of pressure loss in the spot jetting is made larger than the amount of pressure loss in the wide jetting. As a result, the water is decelerated so that the deceleration amount of the water in the spot jetting is made larger. Hence, the flow velocity of the water jetted in the spot jetting can be decreased by a simple deceleration method using the water squirted from the squirting port of the swirling chamber 423 and using the pressure loss of the water due to air mixing based on the ejector effect.

Furthermore the nozzle 410 includes an air mixing section between the squirting port of the swirling chamber 423 and the throat flow channel 431. Specifically, a gap is provided between the nozzle body 420 and the throat 430 to serve as an air mixing section. In the spot jetting, a water flow with the outer periphery granulated is jetted from the squirting port of the swirling chamber 423 so as to bring out the ejector effect. In the wide jetting, a water flow with the outer periphery shaped like a liquid film is jetted from the squirting port of the swirling chamber 423 so as not to bring out the ejector effect.

Thus, on the jetting port 411 side of the squirting port of the swirling chamber 423, a throat flow channel 431 having a larger inner diameter than the squirting port of the swirling chamber 423, and an air mixing section are provided. Hence, the form of the water squirted from the squirting port of the swirling chamber 423 can affect the amount of bubbles mixed into the squirted water. In the wide jetting, a water flow with the outer periphery shaped like a liquid film is jetted from the squirting port of the swirling chamber 423. Hence, while maintaining the liquid film shape, the water travels along the throat flow channel 431 without substantially sucking air from the air mixing section, and can be directly jetted from the jetting port 411. On the other hand, in the spot jetting, a water flow with the outer periphery granulated is jetted from the squirting port of the swirling chamber 423. Hence, the granulated water flow is decelerated by collision with the throat flow channel 431. Furthermore, air is sucked from the air mixing section and mixed into the water by the ejector effect. Thus, the throat flow channel 431 having a larger diameter than the squirting port of the swirling chamber 423, and the air mixing section are provided downstream of the swirling chamber 423 to vary the form of the water flow squirted from the squirting port. Simply by this configuration, the water can be reliably decelerated and squirted in the spot jetting relative to the wide jetting using the same structure.

Here, to mix air into the water, instead of naturally mixing air as described above, an air pump may be used to control the mixing amount of air.

Furthermore, as shown in FIGS. 3 and 4, in the embodiment, to simplify the fabrication of the nozzle body, the configuration allowing commonality is shared by the wide jetting and the spot jetting. More specifically, the wide jetting and the spot jetting share the configuration of the swirling chamber, communication channel, throat, throat flow channel, and jetting port. The wide jetting and the spot jetting are different only in the configuration of the jetting flow channel to the swirling chamber. However, the invention is not limited to the embodiment. There is no problem even if the spot jetting and the wide jetting have greatly different configurations. For instance, the spot jetting may be based on such a configuration in which the water is not swirled but flows from the spot jetting flow channel directly to the communication channel and the throat flow channel.

Next, the impingement force of the water in the wide jetting and the spot jetting is described in more detail with reference to the drawings.

Figure 5:
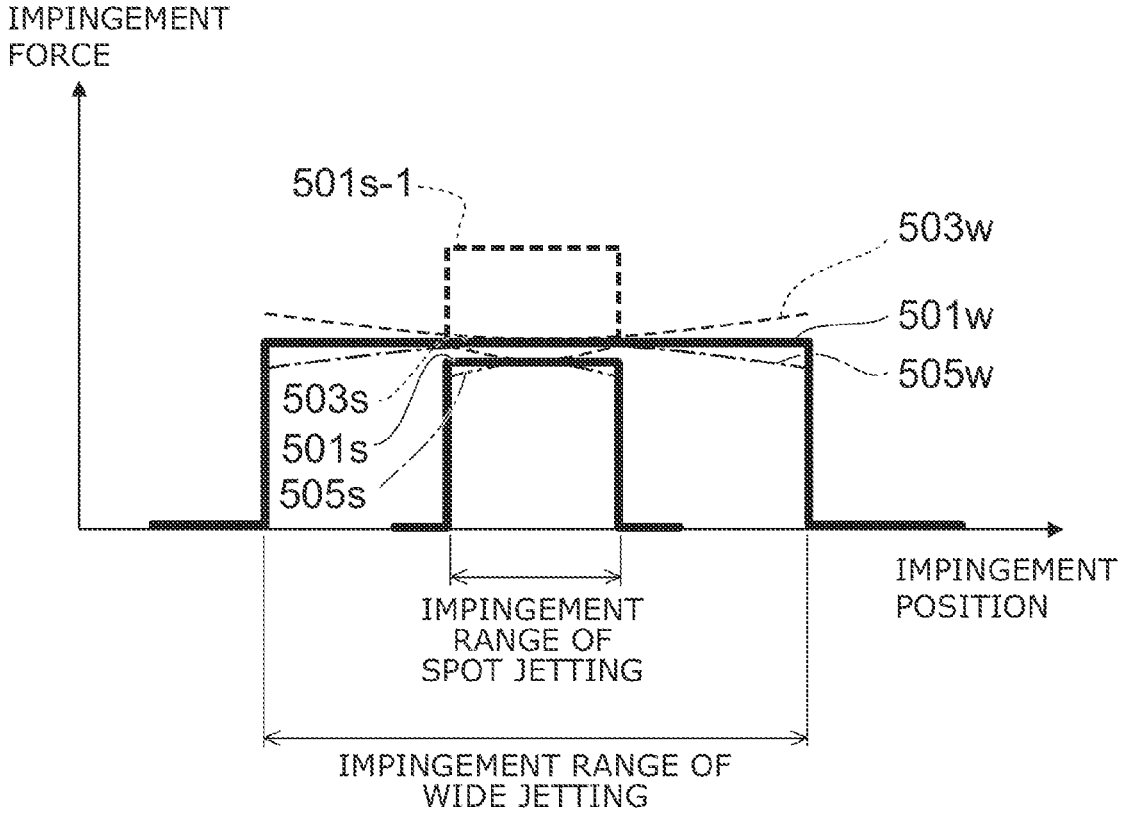
FIG. 5 is a graph showing the impingement force of water at an impingement portion or a position separated by a prescribed distance from a jetting port.

FIG. 5 is a graph showing the impingement force of water at the impingement portion or a position separated by a prescribed distance from the jetting port.

As shown in FIG. 5, in the embodiment, the impingement range of the wide jetting is wider than the impingement range of the spot jetting. In other words, the impingement range of the spot jetting is narrower than the impingement range of the wide jetting. Furthermore, in the example shown in FIG. 5, the impingement force in the central portion of the impingement range of the spot jetting is smaller than the impingement force in the impingement range of the wide jetting. However, the impingement force of the spot jetting may be made comparable to the impingement force of the wide jetting. Alternatively, the impingement force of the spot jetting may be made larger than the impingement force of the wide jetting.

Here, in this specification, the "impingement force" means at least one of the impingement flow velocity, impingement amount of water, and impingement pressure of the water 500. The "impingement force" is also the momentum of water per unit area, and refers to the force of removing, stripping, or releasing dirt. The "impingement flow velocity" refers to the flow velocity of the water 500 at the impingement portion or a position separated by a prescribed distance from the jetting port 411. The "impingement pressure" is the momentum per unit area at the impingement portion or a position separated by a prescribed distance from the jetting port 411, and refers to the force of removing, stripping, or releasing dirt. The "impingement amount of water" is the amount of water impinging per unit time at the impingement portion or a position separated by a prescribed distance from the jetting port 411, and refers to the force of washing away dirt.

In the case where the spot jetting is performed with the same flow rate and flow velocity as the wide jetting, the spot jetting causes the same amount of water as the wide jetting to impinge on a narrower range than the wide jetting. Hence, as shown in FIG. 5, the impingement force 501*s*-1 in the central portion of the impingement range of the spot jetting is larger than the impingement force of the wide jetting. In this case, stimuli applied to the delicate area of the female private parts in the spot jetting are too strong and cause discomfort. Thus, in the embodiment, when starting the spot jetting, or when switching from the wide jetting to the spot jetting, the flow velocity or flow rate of water is made lower, or the mixing amount of air is made larger than in the wide jetting to suppress the impingement force in the spot jetting. That is, the impingement force suppression device is a device for adjusting the flow velocity, flow rate, or mixing amount of air in the spot jetting and the wide jetting. Thus, by squirting water so as to suppress the impingement force in the spot jetting, the impingement force 501*s* of the spot jetting is decreased as shown in FIG. 5. Preferably, the impingement force in the central portion of the impingement range of the spot jetting is made comparable to or smaller than the impingement force in the impingement range of the wide jetting. This prevents unnecessary application of strong stimuli to the delicate area located around the center of the female private parts in the spot jetting. Thus, comfortable bidet washing can be realized.

The impingement force in the central portion of the impingement range of the spot jetting is made smaller than in the case of squirting water at the impingement range of the spot jetting with the same flow rate or flow velocity as in the wide jetting. Furthermore, if the impingement force is made comparable to or smaller than the impingement force in the impingement range of the wide jetting, the spot jetting can provide comfortable washing while more reliably suppressing unnecessary application of strong stimuli to the woman's delicate area located around the center of the female private parts. That is, the spot jetting can realize bide washing with a very comfortable feeling of washing without causing discomfort in the woman's delicate area located around the center of the female private parts.

On the other hand, the wide jetting can cause the water to impinge on a wider range of the female private parts of a user seated on the toilet seat 200 with the granulated water flow 520 evenly distributed in the hollow portion of the hollow-conic jetted water 510. Thus, the wide jetting can wash the desired wide range quickly at once.

Accordingly, the water is squirted from the nozzle 410 with the width of the impingement range of the water switched in accordance with the purpose of bidet washing. The water impinges with an impingement force adapted to the width of the impingement range on the female private parts. Thus, bidet washing can be performed with an impingement force adapted to the width of the impingement range of water in bidet washing.

Here, the distribution of the impingement force in the impingement portion in the wide jetting is not limited to the distribution generally uniform throughout the impingement range like the impingement force 501*w* of the solid line shown in FIG. 5. The distribution of the impingement force in the impingement portion in the wide jetting may be larger in the outer peripheral portion than in the central portion of the impingement range like the impingement force 503*w* of the dashed line shown in FIG. 5. Alternatively, the distribution of the impingement force in the impingement portion in the wide jetting may be smaller in the outer peripheral portion than in the central portion of the impingement range like the impingement force 505*w* of the dot-dashed line shown in FIG. 5.

The distribution of the impingement force in the impingement portion in the spot jetting is not limited to the distribution generally uniform throughout the impingement range like the impingement force 501*s* of the solid line shown in FIG. 5. The distribution of the impingement force in the impingement portion in the spot jetting may be larger in the outer peripheral portion than in the central portion of the impingement range like the impingement force 503*s* of the dashed line shown in FIG. 5. Alternatively, the distribution of the impingement force in the impingement portion in the spot jetting may be smaller in the outer peripheral portion than in the central portion of the impingement range like the impingement force 505*s* of the dot-dashed line shown in FIG. 5.

In the case where the distribution of the impingement force in the impingement portion in the wide jetting and the spot jetting is given by any of the impingement force 501*w*, 503*w*, 505*w* and the impingement force 501*s*, 503*s*, 505*s*, the impingement force in the central portion of the impingement range of the spot jetting is preferably made comparable to or smaller than the impingement force in the impingement range of the wide jetting.

For the impingement force 503*w* of the dashed line shown in FIG. 5, the distribution of the impingement force in the impingement portion in the wide jetting is larger in the outer peripheral portion than in the central portion of the impingement range. In this case, during women's menstruation, for instance, menstrual blood dirt may be attached over a wide range around the female private parts. The above distribution of the impingement force can respond to the demand for washing the wide range quickly at once.

More specifically, the outer peripheral portion of the desired washing area is an area desired to be actively washed in the case where menstrual blood dirt during women's menstruation is attached. Thus, in the case where the impingement force in the outer peripheral portion is larger than the impingement force in the central portion, the water 500 with high washing power impinges on the area where menstrual blood dirt is to be removed. On the other hand, the water with small impingement force impinges on the woman's delicate area. Thus, there is no case where an unnecessarily strong feeling of stimulation is applied. Hence, the sanitary washing apparatus 100 according to the embodiment can remove or release menstrual blood dirt more rapidly, and can realize bidet washing with a very comfortable feeling of washing. Furthermore, the sanitary washing apparatus 100 according to the embodiment can wash away menstrual blood dirt more rapidly, and can realize bidet washing with a very comfortable feeling of washing. Hence, the sanitary washing apparatus 100 according to the embodiment is suitable as an apparatus to be used by a woman during menstruation. In particular, in the outer peripheral portion of the female private parts, menstrual blood dirt tends to be dried and clotted. However, the impingement force in the outer peripheral portion being larger than the impingement force in the central portion is suitable for washing away the clotted menstrual blood dirt.

Furthermore, the sanitary washing apparatus 100 according to the embodiment can cause the water to impinge on a wider range than in the conventional bidet washing irrespective of the distribution of the impingement force in the impingement portion. Hence, in the sanitary washing apparatus 100 according to the embodiment, there is no need to move the impingement position by moving the nozzle 410 in the front-rear direction and left-right direction (see the arrows shown in FIG. 1). Furthermore, there is also no need for the user seated on the toilet seat 200 to move the seated position by oneself to move the impingement position. Hence, in the sanitary washing apparatus 100 according to the embodiment, there is little danger of causing a feeling of being swept in washing a wide range of the female private parts. Also in this respect, the sanitary washing apparatus 100 according to the embodiment can realize bidet washing with a very comfortable feeling of washing.

The impingement force of the wide jetting and the spot jetting can be in forms other than those shown in FIG. 5. For instance, the impingement force of the spot jetting may be slightly larger than the impingement force of the wide jetting. Even in this case, by decreasing the flow velocity or flow rate in the spot jetting, the impingement force can be suppressed to weaken the feeling of stimulation. In particular, when the wide jetting is switched in midstream to the spot jetting by remote control, the washing range is switched without substantial stop time of jetting water. Thus, the water squirted and distributed in a wide range concentrates and impinges on a narrower range. Hence, the impingement force increases and is likely to cause strong stimuli. However, if the flow velocity or flow rate is decreased in the spot jetting so as to suppress the impingement force, unnecessary application of strong stimuli to the delicate area of the female private parts can be suppressed. This also contributes to realizing bidet washing with a very comfortable feeling of washing.

Next, the flow velocity of the water and the flow rate of the water per unit area at the impingement portion or a position separated by a prescribed distance from the jetting port are described. This description takes as an example the case where the impingement force in the impingement portion in the wide jetting is larger in the outer peripheral portion than in the central portion of the impingement range, and the case where the impingement force in the impingement portion in the spot jetting is generally uniform throughout the impingement range.

Figure 6:
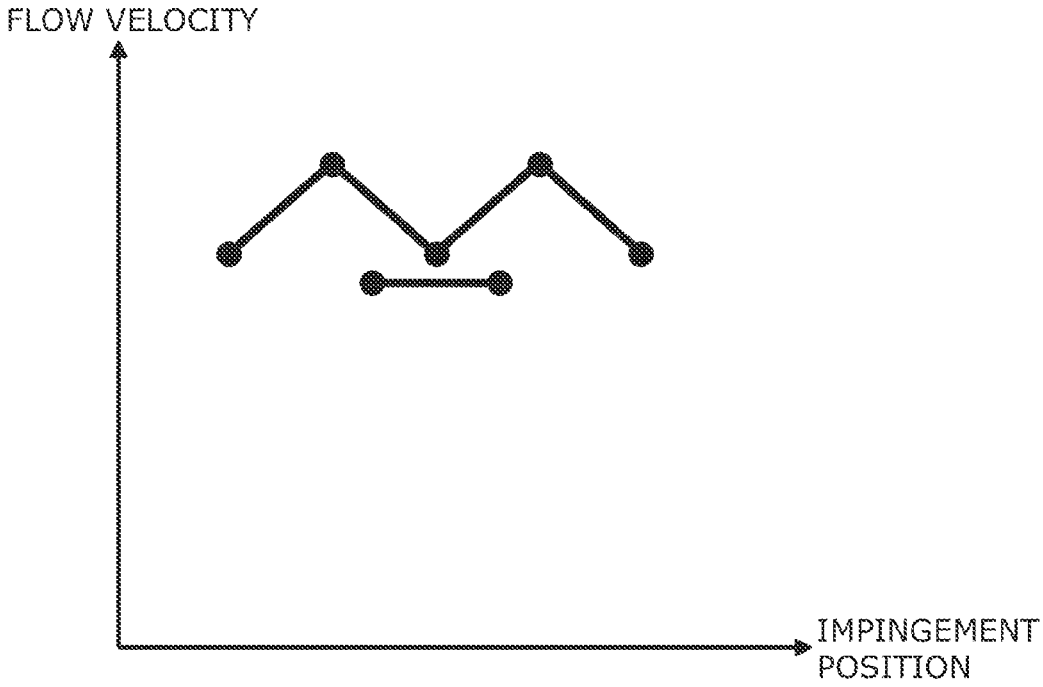
FIG. 6 is a graph showing the flow velocity of water at an impingement portion or a position separated by a prescribed distance from a jetting port.

FIG. 6 is a graph showing the flow velocity of the water at the impingement portion or a position separated by a prescribed distance from the jetting port.

In the embodiment, as shown in FIG. 6, the flow velocity in the central portion of the impingement range of the spot jetting is comparable to or smaller than the flow velocity in the impingement range of the wide jetting. The reason for this is as follows, as described above with reference to FIG. 4. The water squirted from the jetting port 433 in the spot jetting is in a continuous or filled state. On the other hand, the water squirted from the jetting port 433 in the wide jetting is a hollow-conic jetted water 510.

More specifically, in the wide jetting, the water poured into the throat flow channel 431 flows along the inner wall of the throat flow channel 431 while maintaining the swirling power. Hence, as viewed in the axial direction (jetting direction) of the throat flow channel 431, the area of the water occupying the jetting port 433 or the throat flow channel 431 is smaller than that in the spot jetting. On the other hand, in the spot jetting, the throat flow channel 431 is almost filled with water of the rectilinear flow 530 and the water drops 540. Hence, as viewed in the axial direction (jetting direction) of the throat flow channel 431, the area of the water occupying the jetting port 433 or the throat flow channel 431 is larger than that in the wide jetting. Thus, the flow velocity in the central portion of the impingement range of the spot jetting is comparable to or smaller than the flow velocity in the impingement range of the wide jetting.

Accordingly, the spot jetting causes the water to impinge on the female private parts at a lower flow velocity than in the case of squirting water at the impingement range of the spot jetting at the same flow velocity as the wide jetting, and than the wide jetting. Thus, the spot jetting of the embodiment can provide comfortable washing while suppressing unnecessary application of strong stimuli to the woman's delicate area located around the center of the female private parts. On the other hand, the wide jetting causes the water to impinge on the female private parts at a faster flow velocity than the spot jetting. Thus, the wide jetting of the embodiment can wash the peripheral portion of the female private parts with higher washing power. Hence, menstrual blood dirt attached to a wide range around the female private parts can be efficiently washed away.

Furthermore, in accordance with the area of the water occupying the jetting port 433 or the throat flow channel 431 as viewed in the axial direction of the throat flow channel 431, the flow velocity is different between in the wide jetting and in the spot jetting. Hence, by switching between the wide jetting and the spot jetting, a flow velocity difference automatically occurs. Thus, without providing a large-scale device or instrument, the flow velocity can be varied between in the wide jetting and in the spot jetting.

Figure 7:
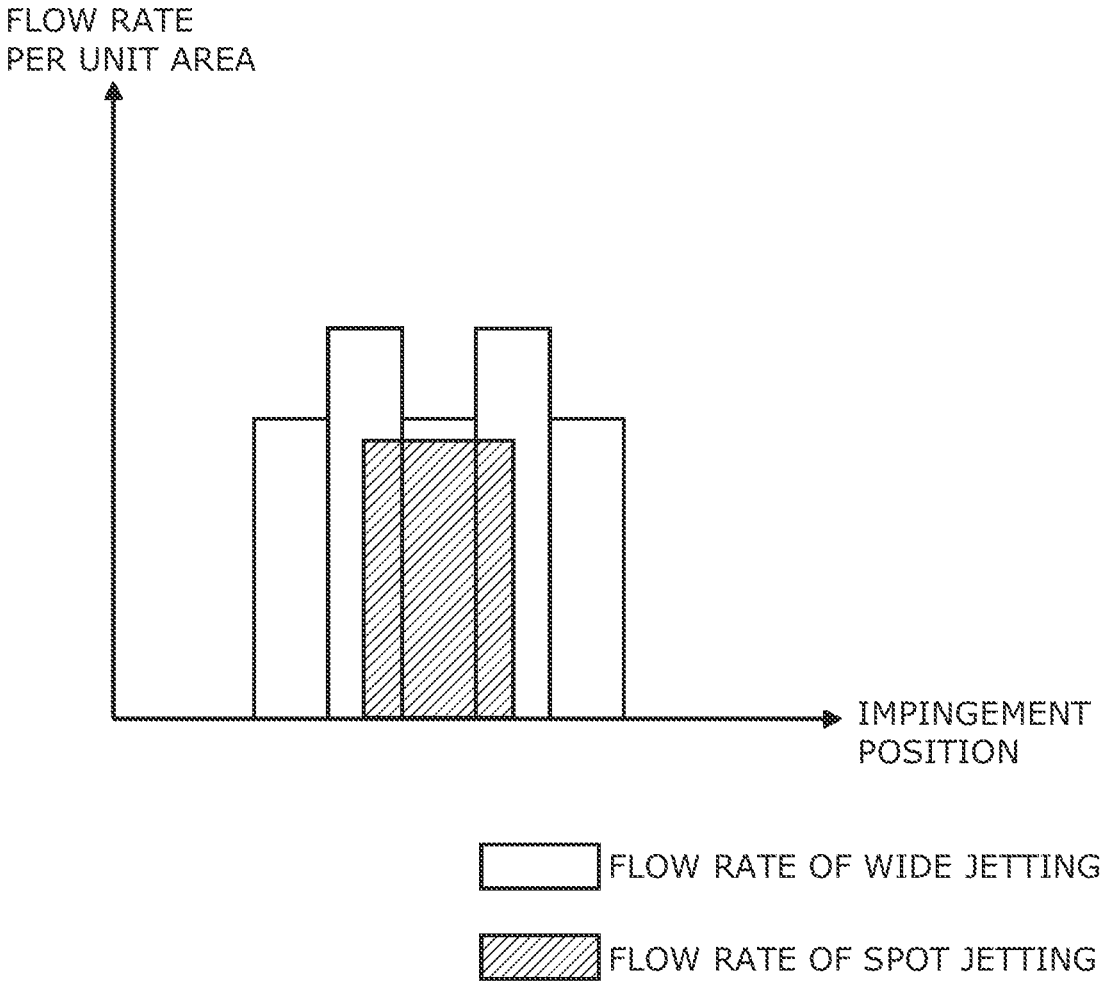
FIG. 7 is a graph showing the flow rate of water per unit area at an impingement portion or a position separated by a prescribed distance from a jetting port.

FIG. 7 is a graph showing the flow rate of the water per unit area at the impingement portion or a position separated by a prescribed distance from the jetting port.

The means for decreasing the impingement force in the central portion of the impingement range of the spot jetting is not limited to varying the flow velocity described above with reference to FIG. 6. To decrease the impingement force in the central portion of the impingement range of the spot jetting, the flow rate of the water per unit area may be varied.

More specifically, based on commands from a controller, not shown, the flow rate regulating valve 480 can make the flow rate of the water per unit area in the central portion of the impingement range of the spot jetting lower than the flow rate of the water per unit area in the impingement range of the wide jetting. Thus, the impingement force in the central portion of the impingement range of the spot jetting can be made comparable to or smaller than the impingement force in the impingement range of the wide jetting.

Accordingly, the spot jetting causes the water to impinge on the female private parts at a lower flow rate than in the case of squirting water at the impingement range of the spot jetting at the same flow rate as the wide jetting, and than the wide jetting. Thus, the spot jetting of the embodiment can provide comfortable washing while suppressing unnecessary application of strong stimuli to the woman's delicate area located around the center of the female private parts. On the other hand, the wide jetting causes the water to impinge on the female private parts at a higher flow rate than the spot jetting. Thus, the washing power of the wide jetting of the embodiment is higher than the washing power of the spot jetting. Hence, menstrual blood dirt attached to a wide range around the female private parts can be efficiently washed away.

Next, an example of the nozzle 410 of the embodiment is described with reference to the drawings.

Figure 8:
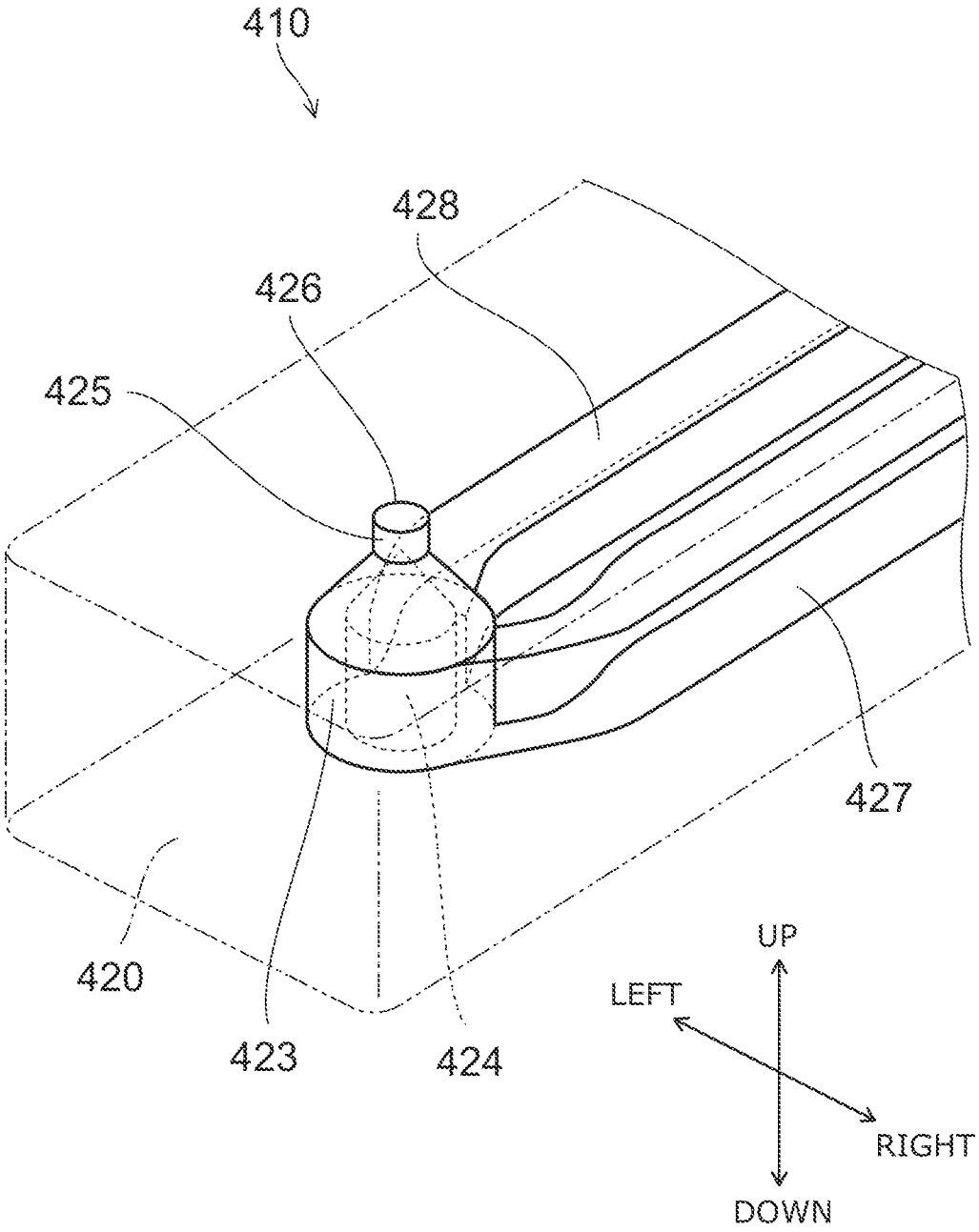
FIG. 8 is a perspective schematic view illustrating an example of a nozzle of the embodiment.

FIG. 8 is a perspective schematic view illustrating the example of the nozzle of the embodiment.

Figure 9:
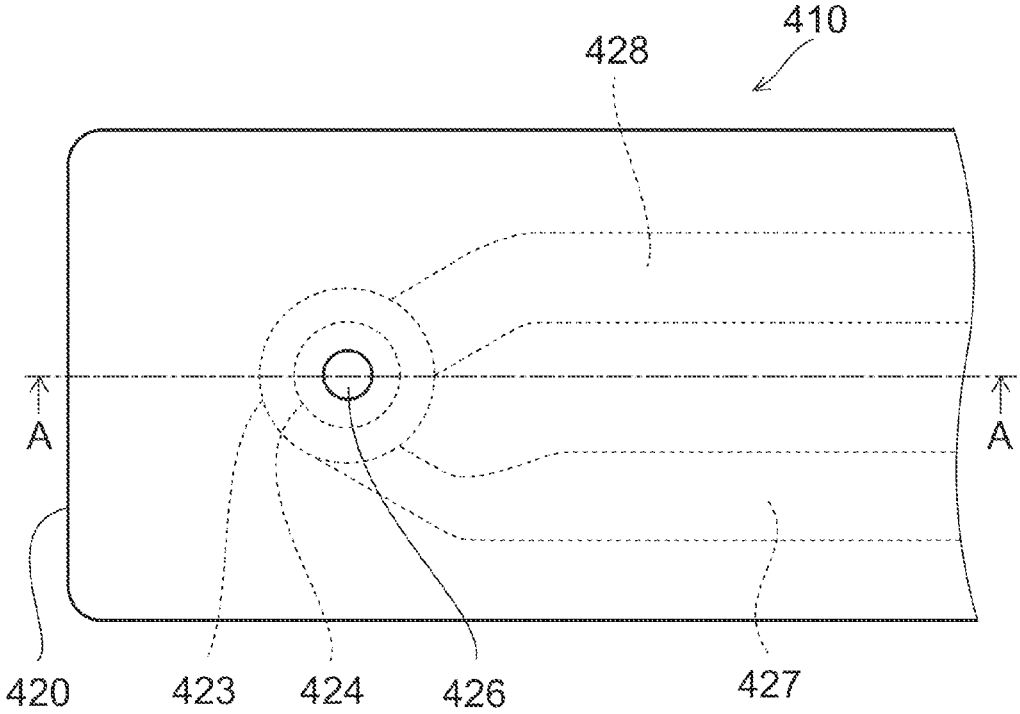
FIG. 9 is a top schematic view of a nozzle of the example as viewed from above.

FIG. 9 is a top schematic view of the nozzle of the example as viewed from above.

Figure 10:
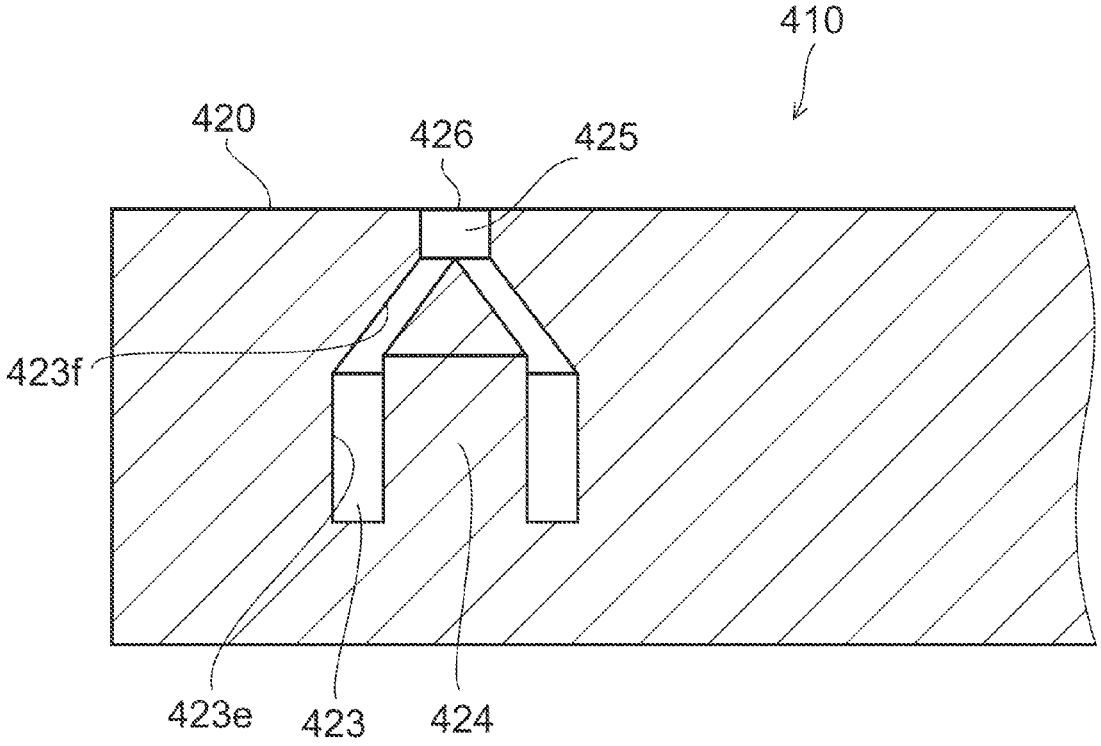
FIG. 10 is a sectional schematic view in the cutting plane A-A shown in FIG. 9.

FIG. 10 is a sectional schematic view in the cutting plane A-A shown in FIG. 9.

The nozzle 410 according to the example includes a nozzle body 420. The nozzle body 420 includes therein a wide jetting flow channel 427 and a spot jetting flow channel 428. As shown in FIG. 9, the wide jetting flow channel 427 is connected in the tangential direction of the large diameter inner peripheral wall 423*e* of the swirling chamber 423. On the other hand, as shown in FIG. 9, the spot jetting flow channel 428 is connected to the large diameter inner peripheral wall 423*e* toward the axial center of the swirling chamber 423. The rest of the structure is similar to the structure of the nozzle 410 described above with reference to FIGS. 3 and 4.

The wide jetting flow channel 427 is connected in the tangential direction of the large diameter inner peripheral wall 423*e* of the swirling chamber 423. Hence, the water poured into the swirling chamber 423 through the wide jetting flow channel 427 swirls along the large diameter inner peripheral wall 423*e* and the inclined inner peripheral wall 423*f*. This is as described above with reference to FIG. 3. On the other hand, the spot jetting flow channel 428 is connected to the large diameter inner peripheral wall 423*e* toward the axial center of the swirling chamber 423. Hence, the water poured into the swirling chamber 423 through the spot jetting flow channel 428 is squirted from one end of the communication channel 425, i.e., the jetting port 426, without swirling or in the state of low swirling force. This is as described above with reference to FIG. 4.

Thus, in the nozzle 410 of the example, if the water is poured into the swirling chamber 423 through only the wide jetting flow channel 427, a hollow-conic jetted water 510 having a larger swirling force can be jetted from the jetting port 426. Furthermore, in the case where the nozzle 410 according to the example includes a throat 430 shown in FIG. 3, the hollow-conic jetted water 510 squirted from the jetting port 433 transitions to a granulated water flow 520. Thus, in this case, the user can wash a wider range quickly at once.

In contrast, the water can be poured into the swirling chamber 423 not only through the wide jetting flow channel 427 but through the wide jetting flow channel 427 and the spot jetting flow channel 428. In this case, the swirling force of the swirling flow occurring in the swirling chamber 423 is made lower than in the case of pouring the water into the swirling chamber 423 through only the wide jetting flow channel 427. This is because the swirling flow of the water poured into the swirling chamber 423 from the wide jetting flow channel 427 interferes with the rectilinear flow of the water poured into the swirling chamber 423 from the spot jetting flow channel 428. Thus, in this case, the hollow-conic jetted water 510 squirted from the jetting port 426 has a smaller swirling force than in the case of pouring the water into the swirling chamber 423 through only the wide jetting flow channel 427.

Furthermore, in contrast, if the water is poured into the swirling chamber 423 through only the spot jetting flow channel 428, a rectilinear flow 530 and water drops 540 can be jetted from the jetting port 426. Thus, in this case, the user can intensively wash the intended washing site as desired.

Accordingly, in the case of pouring the water into the swirling chamber 423 through the wide jetting flow channel 427 and the spot jetting flow channel 428, and in the case of pouring the water into the swirling chamber 423 through only the spot jetting flow channel 428, a narrower range can be washed than in the case of pouring the water into the swirling chamber 423 through only the wide jetting flow channel 427. That is, the user can intensively wash the intended washing site as desired.

Hence, according to the example, the user can appropriately change the setting of the ratio of the flow rate of the water passing through the wide jetting flow channel 427 to the flow rate of the water passing through the spot jetting flow channel 428. Thus, the user can switch as desired between the wide jetting for washing a wider range quickly at once and the spot jetting for intensively washing a narrower range.

Next, an example of the water-pressure modulator 470 of the embodiment is described with reference to the drawings.

Figure 11:
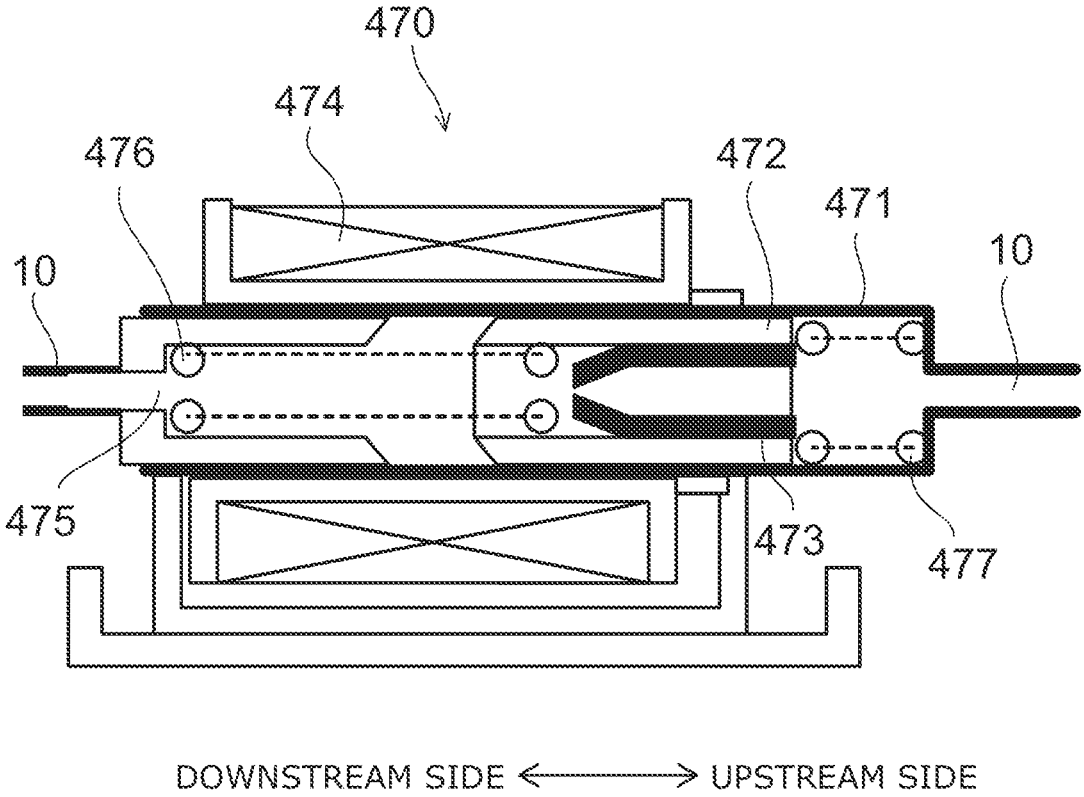
FIG. 11 is a sectional schematic view illustrating an example of a water-pressure modulator of the embodiment.

FIG. 11 is a sectional schematic view illustrating the example of the water-pressure modulator of the embodiment.

As described above with reference to FIG. 2, the sanitary washing apparatus 100 according to the embodiment includes a water-pressure modulator 470 for providing pulsation to the flow of water in the flow channel 10. Thus, the water-pressure modulator 470 provides pulsation to the water squirted from the jetting port 411 of the nozzle 410. Based on commands from a controller, not shown, the water-pressure modulator 470 is activated in the spot jetting to provide pulsation to the flow of water in the flow channel 10. This pulsated flow of water is squirted from the jetting port with velocity differences due to pressure variation, i.e., so as to alternately repeat the state of large flow velocity and the state of small flow velocity. The water with velocity differences causes a phenomenon in which a portion with fast velocity overtakes a portion with slow velocity after squirting. By the uniting of water portions, the cross-sectional area of the water intermittently increases. Thus, even if the flow rate of the water decreases in the spot jetting, the decrease of the feeling of volume can be suppressed, and the feeling of washing can be made higher.

Here, in the wide jetting, the water-pressure modulator 470 is not activated, and the water is squirted without pulsation.

As described above, the water-pressure modulator 470 shown in FIG. 11 can provide pulsation to the flow of water in the flow channel 10. Here, the term "pulsation" used herein refers to pressure variation caused by the water-pressure modulator 470. Thus, the water-pressure modulator 470 is a device for varying the pressure of water in the flow channel 10.

As shown in FIG. 11, the water-pressure modulator 470 includes a cylinder 471 connected to the flow channel 10, a plunger 472 reciprocably provided inside the cylinder 471, a check valve 473 provided inside the plunger 472, and a pulsation generating coil 474 for reciprocating the plunger 472 under a controlled excitation voltage.

The check valve is disposed so that the pressure of water on the downstream side of the water-pressure modulator 470 increases when the position of the plunger 472 is changed to the nozzle 410 side (downstream side), and that the pressure of water on the downstream side of the water-pressure modulator 470 decreases when the position of the plunger 472 is changed to the side opposite to the nozzle 410 (upstream side). In other words, the pressure of water on the upstream side of the water-pressure modulator 470 decreases when the position of the plunger 472 is changed to the nozzle 410 side (downstream side). The pressure of water on the upstream side of the water-pressure modulator 470 increases when the position of the plunger 472 is changed to the side opposite to the nozzle 410 (upstream side).

The plunger 472 is moved to the upstream or downstream side by controlling the excitation of the pulsation generating coil 474. That is, to add pulsation to the water in the flow channel 10 (to vary the pressure of the water in the flow channel 10), the plunger 472 is reciprocated in the axial direction (upstream/downstream direction) of the cylinder 471 by controlling the excitation voltage applied to the pulsation generating coil 474.

Here, by excitation of the pulsation generating coil 474, the plunger 472 moves from the original position (plunger original position) as shown to the downstream side 475. Then, when the excitation of the pulsation generating coil 474 is extinguished, the plunger 472 returns to the original position by the biasing force of a return spring 476. Here, a buffer spring 477 buffers the return motion of the plunger 472. The plunger 472 includes therein a duckbill check valve 473 to prevent backflow to the upstream side.

Hence, when the plunger 472 moves from the plunger original position to the downstream side, the plunger 472 can pressurize water in the cylinder 471 to drive the water to the flow channel 10 on the downstream side. In other words, when the plunger 472 moves from the plunger original position to the downstream side, the plunger 472 can decompress water in the flow channel 10 on the upstream side to suck the water into the cylinder 471. Here, because the plunger original position and the position after the motion to the downstream side are always the same, the amount of water fed to the flow channel 10 on the downstream side in response to the motion of the plunger 472 is constant.

Subsequently, at the time of return to the original position, water flows into the cylinder 471 through the check valve 473. Thus, at the next time when the plunger 472 moves to the downstream side, a constant amount of water is newly fed to the flow channel 10 on the downstream side. Thus, the water-pressure modulator 470 shown in FIG. 11 can provide pulsation to the flow of water in the flow channel 10.

As described above, according to the embodiment, the spot jetting and the wide jetting can be performed. The spot jetting squirts water from the jetting port 411 of the nozzle 410 so that the water impinges on the first range of the female private parts. The wide jetting squirts water from the jetting port 411 of the nozzle 410 so that the water impinges evenly on the second range wider than the first range. That is, the user can switch as desired between the wide jetting for washing a wider range quickly at once and the spot jetting for intensively washing a narrower range. The flow velocity in the central portion of the impingement range of the spot jetting is comparable to or slower than the flow velocity in the impingement range of the wide jetting. The impingement force in the central portion of the impingement range of the spot jetting is comparable to or smaller than the impingement force in the impingement range of the wide jetting.

The wide jetting can cause the water to impinge on a wider range of the female private parts of a user seated on the toilet seat 200 with the granulated water flow 520 evenly distributed in the hollow portion of the hollow-conic jetted water 510. Thus, the desired wide range can be washed quickly at once. The spot jetting can wash a narrower range than the wide jetting. Furthermore, the spot jetting can suppress unnecessary application of strong stimuli to the woman's delicate area located around the center of the female private parts. Thus, bidet washing with a very comfortable feeling of washing can be realized.

Accordingly, the water is squirted from the nozzle 410 with the width of the impingement range of the water switched in accordance with the purpose of bidet washing. The water impinges with an impingement force adapted to the width of the impingement range on the female private parts. Thus, bidet washing can be performed with an impingement force adapted to the width of the impingement range of water in bidet washing.

Next, an alternative embodiment of the invention is described with reference to the drawings.

Figure 12:
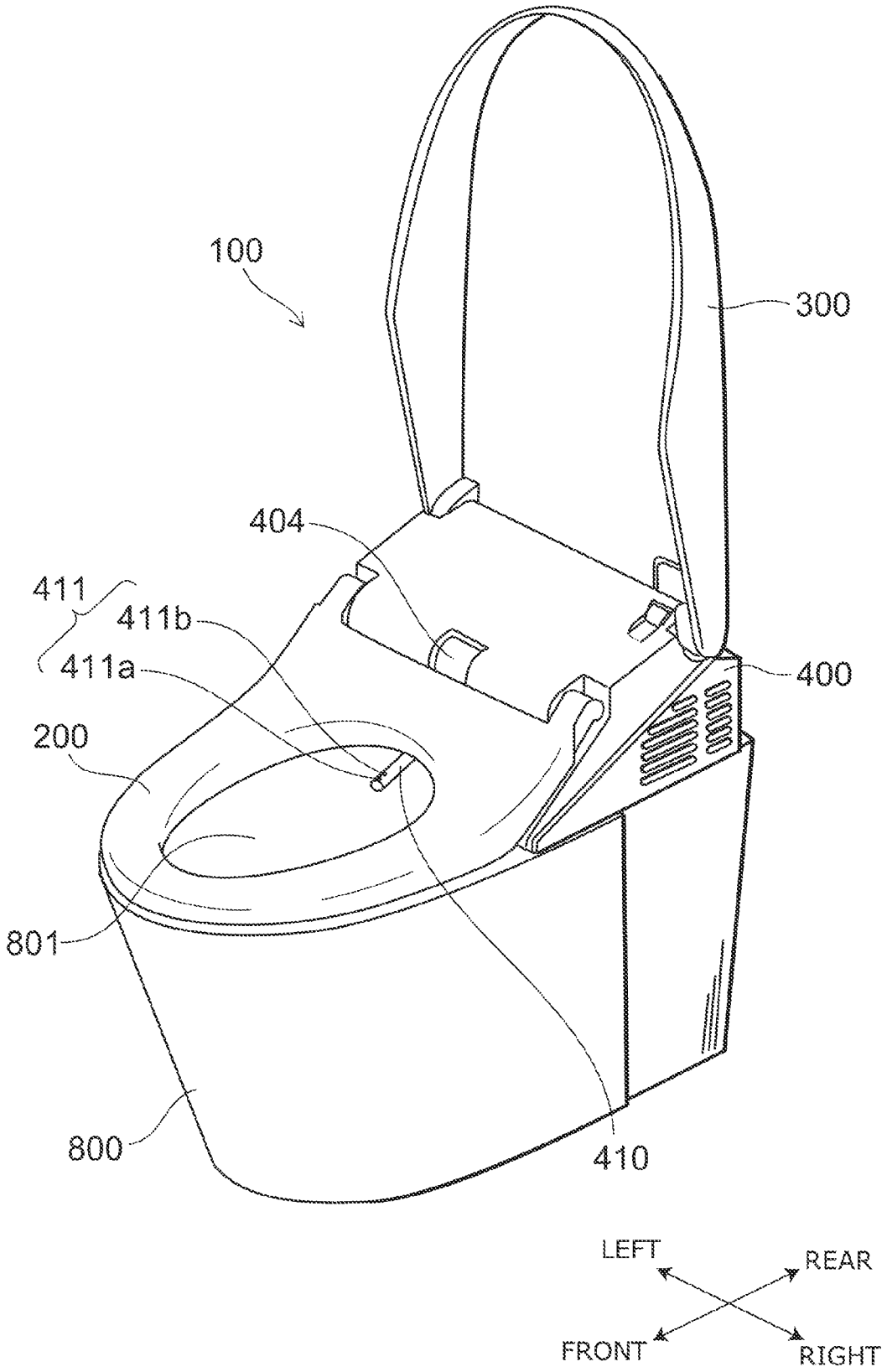
FIG. 12 is a perspective schematic view showing a toilet apparatus equipped with a sanitary washing apparatus according to an alternative embodiment of the invention.

FIG. 12 is a perspective schematic view showing a toilet apparatus equipped with a sanitary washing apparatus according to the alternative embodiment of the invention.

In the tip portion of the nozzle 410 according to the embodiment, at least two jetting ports 411 are provided. For instance, in the nozzle 410 shown in FIG. 12, among the two jetting ports 411, one jetting port 411*a* is a second jetting port for wide jetting (second jetting), and the other jetting port 411*b* is a first jetting port for spot jetting (first jetting).

The sanitary washing apparatus 100 according to the embodiment can perform spot jetting (first jetting) for squirting water from the first jetting port 411*b* of the nozzle 410 so that the water impinges on a first range of the female private parts, and wide jetting (second jetting) for squirting water from the second jetting port 411*a* of the nozzle 410 so that the water impinges evenly on a second range wider than the first range. The rest of the structure of the toilet apparatus and the sanitary washing apparatus and the operation of the wide jetting and the spot jetting are similar to the structure of the toilet apparatus and the sanitary washing apparatus and the operation of the wide jetting and the spot jetting described above with reference to FIGS. 1 to 11.

Next, an example of the nozzle 410 of the embodiment is described with reference to the drawings.

Figure 13:
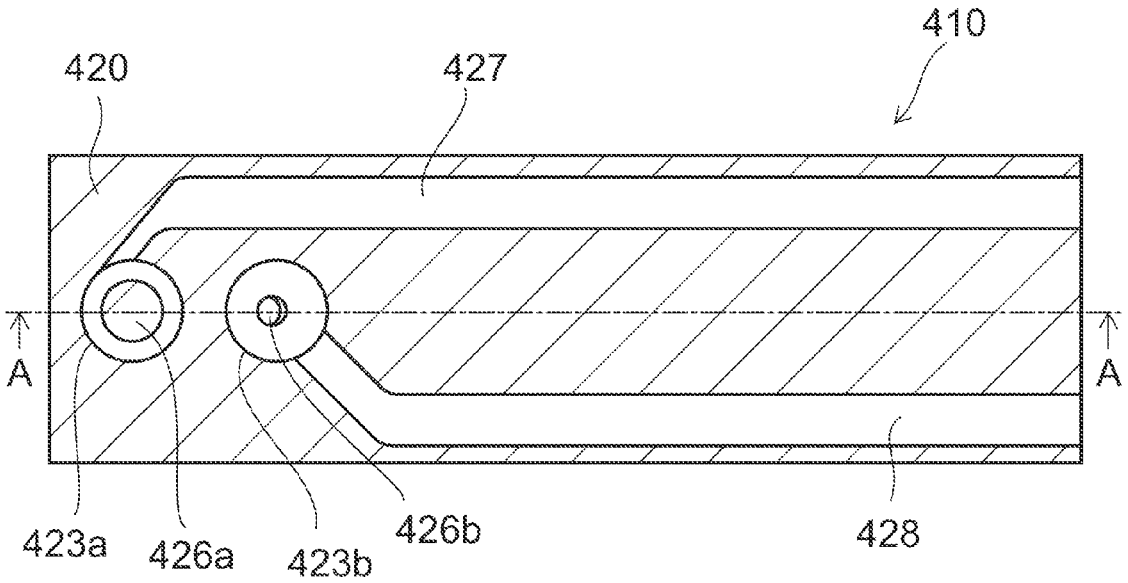
FIG. 13 is a top schematic view illustrating an example of a nozzle of the embodiment.

FIG. 13 is a top schematic view illustrating the example of the nozzle of the embodiment.

Figure 14:
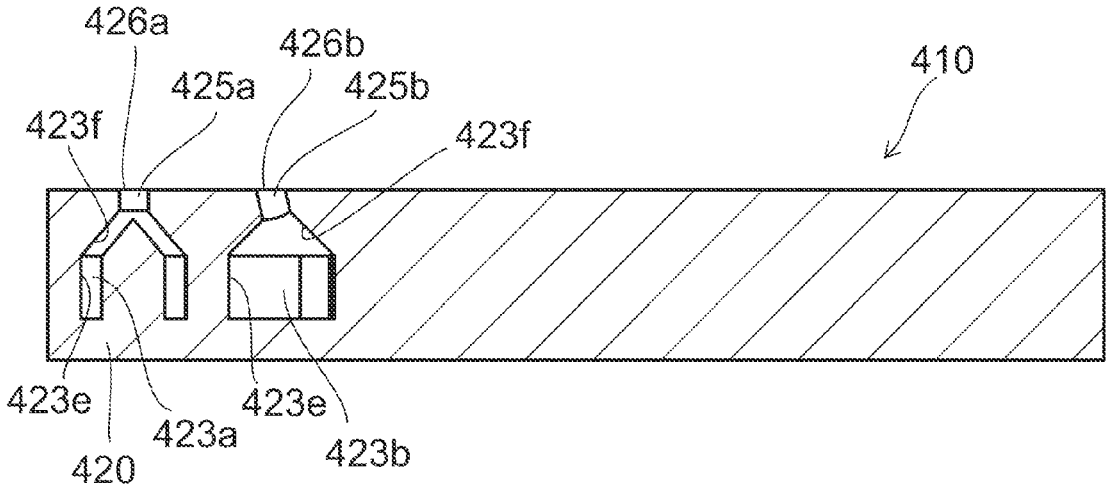
FIG. 14 is a sectional schematic view in the cutting plane A-A shown in FIG. 13.

FIG. 14 is a sectional schematic view in the cutting plane A-A shown in FIG. 13.

The nozzle 410 according to the example includes a nozzle body 420. The nozzle body 420 includes therein a wide jetting flow channel 427 and a spot jetting flow channel 428. The wide jetting flow channel 427 is connected in the tangential direction of the large diameter inner peripheral wall 423*e* of a first swirling chamber 423*a*. On the other hand, the spot jetting flow channel 428 is connected to the large diameter inner peripheral wall 423*e* toward the axial center of a second swirling chamber 423*b*. The rest of the structure is similar to the structure of the nozzle 410 described above with reference to FIGS. 3 and 4.

The wide jetting flow channel 427 is connected in the tangential direction of the large diameter inner peripheral wall 423*e* of the first swirling chamber 423*a*. Hence, the water poured into the first swirling chamber 423*a* through the wide jetting flow channel 427 swirls along the large diameter inner peripheral wall 423*e* and the inclined inner peripheral wall 423*f*. This is as described above with reference to FIG. 3. On the other hand, the spot jetting flow channel 428 is connected to the large diameter inner peripheral wall 423*e* toward the axial center of the second swirling chamber 423*b*. Hence, the water poured into the second swirling chamber 423*b* through the spot jetting flow channel 428 is squirted from one end of the second communication channel 425*b*, i.e., the first jetting port 426*b*, without swirling or in the state of low swirling force. This is as described above with reference to FIG. 4.

Thus, in the nozzle 410 of the example, if the water is poured into the first swirling chamber 423*a* through the wide jetting flow channel 427, a hollow-conic jetted water 510 having a larger swirling force can be jetted from the second jetting port 426*a*. Furthermore, in the case where the nozzle 410 of the example includes a throat 430 shown in FIG. 3, the hollow-conic jetted water 510 squirted from the second jetting port 426*a* transitions to a granulated water flow 520. Thus, in this case, the user can wash a wider range quickly at once.

Furthermore, if the water is poured into the second swirling chamber 423*b* through the spot jetting flow channel 428, a rectilinear flow 530 and water drops 540 can be jetted from the first jetting port 426*b*. Thus, in this case, the user can intensively wash the intended washing site as desired.

In the wide jetting flow channel 427, the water is poured into the first swirling chamber 423*a* so as to have large swirling force. By the large swirling force, flow contraction occurs near the jetting port and results in pressure loss. However, the incoming water pressure of the poured water is made higher in the wide jetting flow channel 427 than in the spot jetting flow channel 428. Thus, the flow velocity of the wide jetting can be made higher than the flow velocity of the spot jetting. On the other hand, in the spot jetting, the water is poured into the second swirling chamber 423*b* so as not to have large swirling force. Thus, the pressure loss is low, and high pressure is not needed. Hence, the incoming water pressure is made low to suppress the flow velocity.

To change the incoming water pressure, a throttle is provided in the flow rate regulating valve or the intermediate flow channel communicating with the spot jetting flow channel 428 so that the pressure loss is made higher than in the flow channel communicating with the wide jetting flow channel 427. Alternatively, a pump, for instance, may be installed, and the output of the pump may be adjusted to change the incoming water pressure.

Furthermore, the cross-sectional area of the second jetting port 426*a* as viewed in the jetting direction of the water squirted from the jetting port is made larger than that of the first jetting port 426*b*. Hence, by switching between the wide jetting and the spot jetting, a flow velocity difference automatically occurs. Thus, without providing a large-scale device or instrument, the flow velocity can be varied between in the first jetting and in the second jetting.

Hence, according to the example, the user can change the flow channel of the water between the wide jetting flow channel 427 and the spot jetting flow channel 428. Thus, the user can switch as desired between the wide jetting for washing a wider range quickly at once and the spot jetting for intensively washing a narrower range.

Next, an alternative example of the nozzle 410 of the embodiment is described with reference to the drawings.

Figure 15:
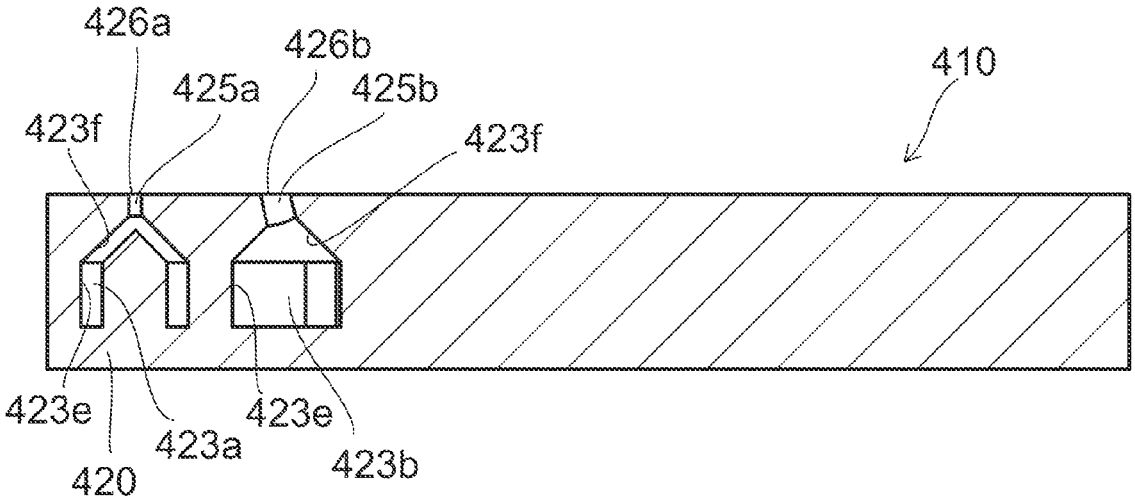
FIG. 15 is a sectional schematic view of an alternative example in the cutting plane A-A shown in FIG. 13.

FIG. 15 is a sectional schematic view of the alternative example in the cutting plane A-A shown in FIG. 13.

The nozzle 410 according to the alternative example is similar in structure to the nozzle 410 described above with reference to FIGS. 13 and 14. Hence, differences from the above example are described below.

In the example shown in FIG. 14, the first communication channel 425*a* for the wide jetting and the second communication channel 425*b* for the spot jetting have a generally equal cross-sectional area as viewed in the jetting direction of the squirted water. However, in the alternative example shown in FIG. 15, the first communication channel 425*a* is formed so that the cross-sectional area as viewed in the jetting direction of the squirted water is smaller than that of the second communication channel 425*b*.

Hence, in the alternative example, for instance, the flow rate may be made comparable between in the wide jetting and in the spot jetting. In other words, the flow rate of the water flowing in the wide jetting flow channel 427 may be made comparable to the flow rate of the water flowing in the spot jetting flow channel 428 in FIG. 13. Even in this case, because the diameter of the first communication channel 425*a* for the wide jetting is narrowed, the water can be squirted so that the flow velocity in the first range of the spot jetting is slower than the flow velocity in the second range of the wide jetting. Hence, by switching between the wide jetting and the spot jetting, a flow velocity difference automatically occurs. Thus, without providing a large-scale device or instrument, the flow velocity can be varied between in the first jetting and in the second jetting.

Hence, also in the alternative example, the user can change the flow channel of the water between the wide jetting flow channel 427 and the spot jetting flow channel 428. Thus, the user can switch as desired between the wide jetting for washing a wider range quickly at once and the spot jetting for intensively washing a narrower range.

The embodiments of the invention have been described above. However, the invention is not limited to the above description. Those skilled in the art can suitably modify the above embodiments, and such modifications are also encompassed within the scope of the invention as long as they include the features of the invention. For instance, the shape, dimension, material, and layout of various components in e.g. the nozzle 410 are not limited to those illustrated, but can be suitably modified.

Furthermore, various components in the above embodiments can be combined with each other as long as technically feasible. Such combinations are also encompassed within the scope of the invention as long as they include the features of the invention.

What is claimed is:

1. A sanitary washing apparatus comprising:

a nozzle including a jetting port, a swirling chamber and a protrusion and configured to squirt water from the jetting port and to cause the water to impinge on female private parts, the nozzle being operable to switch between a first jetting and a second jetting, the first jetting squirting the water from the jetting port to cause the water to impinge on a first range located around a center of the female private parts, and the second jetting squirting the water from the jetting port more diffusively than the first jetting to cause the water to impinge evenly on a second range wider than the first range without moving the jetting port, the second range including the first range, the swirling chamber being provided below the jetting port and configured to swirl the water, the protrusion being fixed to a central portion of the swirling chamber and configured to generate a swirling flow, the water being squirted so that flow velocity in the first range of the first jetting is slower than flow velocity in the second range of the second jetting.

2. The apparatus according to claim 1, wherein area of the water occupying the jetting port as viewed in jetting direction of the water squirted from the jetting port is made larger in the first jetting than in the second jetting.

3. The apparatus according to claim 1, wherein the water is squirted from the swirling chamber with swirling speed of the water in the swirling chamber in the first jetting made slower than in the second jetting.

4. The apparatus according to claim 3, wherein the nozzle includes a deceleration device configured to make the flow velocity of the water squirted from the jetting port in the first jetting slower than the flow velocity of the water squirted from the jetting port in the second jetting.

5. The apparatus according to claim 4, wherein the deceleration device includes an air mixing section configured to mix air into the water jetted from the swirling chamber, and the air mixing section makes mixing amount of air larger in the first jetting than in the second jetting.

6. The apparatus according to claim 5, wherein in the first jetting, the water with outer peripheral side of the jetted water being in a granulated state is supplied through the air mixing section to the jetting port, and in the second jetting, the water with outer peripheral side of the jetted water being in a water film state is supplied through the air mixing section to the jetting port.

7. The apparatus according to claim 1, further comprising:

a water-pressure modulator configured to provide pulsation to flow of the water, in the first jetting, the water-pressure modulator being activated to provide pulsation to the flow of the water squirted from the jetting port to continuously change the flow velocity of the water, and in the second jetting, the water being squirted from the jetting port without activating the water-pressure modulator.

8. The apparatus according to claim 1, wherein the nozzle further includes:

a throttle configured to squirt the water at the jetting port;

a first water supply channel configured to supply the water to the throttle while swirling the water;

a second water supply channel configured to supply the water to the throttle while swirling the water to a degree lower than degree of swirling of the water supplied from the first water supply channel, or without swirling the water; and a channel selection device configured to supply the water to the second water supply channel when performing the first jetting, and to supply the water to the first water supply channel when performing the second jetting.

9. The apparatus according to claim 1, wherein the jetting port includes at least a first jetting port and a second jetting port, and the first jetting jets water from the first jetting port, and the second jetting jets water from the second jetting port.

10. A sanitary washing apparatus comprising:

a nozzle including a jetting port, a swirling chamber and a protrusion and configured to squirt water from the jetting port and to cause the water to impinge on female private parts, the nozzle being operable to switch between a first jetting and a second jetting, the first jetting squirting the water from the jetting port to cause the water to impinge on a first range located around a center of the female private parts, and the second jetting squirting the water from the jetting port more diffusively than the first jetting to cause the water to impinge evenly on a second range wider than the first range without moving the jetting port, the second range including the first range, the swirling chamber being provided below the jetting port and configured to swirl the water, the protrusion being fixed to a central portion of the swirling chamber and configured to generate a swirling flow, the nozzle including an impingement force suppression device configured to suppress impingement force in the first range of the first jetting when the second jetting is switched to the first jetting.

11. The apparatus according to claim 10, wherein when the second jetting is switched to the first jetting, the impingement force suppression device makes flow velocity in the first range of the first jetting slower than flow velocity in the second range of the second jetting to suppress the impingement force in the first range of the first jetting.

12. The apparatus according to claim 10, wherein the impingement force suppression device squirts the water at a lower flow rate in the first jetting than in the second jetting.

13. The apparatus according to claim 10, wherein the first jetting and the second jetting cause the water to be granulated and squirted from the jetting port, and the impingement force suppression device granulates the water so that particle diameter is smaller in the first jetting than in the second jetting.

* * * * *